US008638961B2

(12) United States Patent
Pontoppidan

(10) Patent No.: US 8,638,961 B2
(45) Date of Patent: Jan. 28, 2014

(54) HEARING AID ALGORITHMS

(71) Applicant: Oticon A/S, Smorum (DK)

(72) Inventor: Niels Henrik Pontoppidan, Smorum (DK)

(73) Assignee: Oticon A/S, Smorum (DK)

( * ) Notice: Subject to any disclaimer, the term of this patent is extended or adjusted under 35 U.S.C. 154(b) by 0 days.

(21) Appl. No.: 13/628,952

(22) Filed: Sep. 27, 2012

(65) Prior Publication Data

US 2013/0028453 A1 Jan. 31, 2013

Related U.S. Application Data

(62) Division of application No. 12/625,950, filed on Nov. 25, 2009, now Pat. No. 8,300,861.

(30) Foreign Application Priority Data

Nov. 26, 2008 (EP) ..... 08105874

(51) Int. Cl.
*H04R 25/00* (2006.01)

(52) U.S. Cl.
USPC ..... 381/313; 381/316; 381/312

(58) Field of Classification Search
USPC ..... 381/316, 317, 17, 312, 313
See application file for complete search history.

(56) References Cited

U.S. PATENT DOCUMENTS 5,408,581 A 4/1995 Suzuki et al.
5,717,818 A 2/1998 Nejime et al.
7,231,055 B2 6/2007 Uvacek et al.
2002/0051549 A1 5/2002 Uvacek et al.
2004/0165731 A1 8/2004 Ribic
2005/0069162 A1 3/2005 Haykin et al.
2006/0177079 A1 * 8/2006 Baekgaard Jensen et al. ..... 381/312
2006/0215841 A1 * 9/2006 Vieilledent et al. ..... 381/17
2007/0127753 A1 6/2007 Feng et al.
2007/0206824 A1 9/2007 Hellgren et al.
2009/0147977 A1 6/2009 Lamm et al.

FOREIGN PATENT DOCUMENTS

EP 0 837 588 A2 4/1998

* cited by examiner

*Primary Examiner* — Duc Nguyen
*Assistant Examiner* — Phan Le
(74) *Attorney, Agent, or Firm* — Birch, Stewart, Kolasch & Birch, LLP

(57) ABSTRACT

The invention relates to a method of operating an audio processing device. The invention further relates to an audio processing device, to a software program and to a medium having instructions stored thereon. The object of the present invention is to provide improvements in the processing of sounds in listening devices. The problem is solved by a method comprising a) receiving an electric input signal representing an audio signal; b) providing an event-control parameter indicative of changes related to the electric input signal and for controlling the processing of the electric input signal; c) storing a representation of the electric input signal or a part thereof; d) providing a processed electric output signal with a configurable delay based on the stored representation of the electric input signal or a part thereof and controlled by the event-control parameter. The invention may e.g. be used in hearing instruments, headphones or headsets or active ear plugs.

17 Claims, 12 Drawing Sheets

HEARING AID ALGORITHMS

This application is a Divisional of co-pending application Ser. No. 12/625,950, filed on Nov. 25, 2009, and for which priority is claimed under 35 U.S.C. §120. This application claims priority of Application No. EP 08105874.5, filed on Nov. 26, 2008, under 35 U.S.C. §119; the entire contents of all are hereby incorporated by reference.

TECHNICAL FIELD

The present invention relates to improvements in the processing of sounds in listening devices, in particular in hearing instruments. The invention relates to improvements in the handling of sudden changes in the acoustic environment around a user or to ease the separation of sounds for a user. The invention relates specifically to a method of operating an audio processing device for processing an electric input signal representing an audio signal and providing a processed electric output signal.

The invention furthermore relates to an audio processing device.

The invention furthermore relates to a software program for running on a signal processor of a hearing aid system and to a medium having instructions stored thereon.

The invention may e.g. be useful in applications such as hearing instruments, headphones or headsets or active ear plugs.

BACKGROUND ART

The following account of the prior art relates to one of the areas of application of the present invention, hearing aids.

A considerable body of literature deals with Blind Source Separation (BSS), semi-blind source separation, spatial filtering, noise reduction, beamforming with microphone arrays, or the more overall topic Computational Auditory Scene Analysis (CASA). In general such methods are more or less capable of separating concurrent sound sources either by using different types of cues, such as the cues described in Bregman's book [Bregman, 1990] or used in machine learning approaches [e.g. Roweis, 2001].

Recently binary masks and beamforming where combined in order to extract more concurrent sources than the number of microphones (cf. Pedersen, M. S., Wang, D., Larsen, J., Kjems, U., *Overcomplete Blind Source Separation by Combining ICA and Binary Time-Frequency Masking*, IEEE International workshop on Machine Learning for Signal Processing, pp. 15-20, 2005). That work was, aimed at being able to separate more than two acoustic sources from two microphones. The general output of such algorithms is either the separated sound source at either source position or at microphone position with none or little information from the other sources. If spatial cues are not available, monaural approaches have been suggested and tested (c.f. e.g. [Jourjine, Richard, and Yilmas, 2000]; [Roweis, 2001]; [Pontoppidan and Dyrholm, 2003]; [Bach and Jordan, 2005]).

Adjustable delays in hearing instruments has been described in EP 1 801 786 A1, where the throughput delay can be adjusted in order to trade off between processing delay and delay artefact. U.S. Pat. No. 7,231,055 B2 teaches a method of removing masking-effects in a hearing aid. The method may include delaying a sound that would otherwise have been masked for the hearing impaired by another sound.

DISCLOSURE OF INVENTION

The core concept of the present invention is that an audio signal, e.g. an input sound picked up by an input transducer of (or otherwise received by) an audio processing device, e.g. a listening device such as a hearing instrument, can be delayed (stored), possibly processed to extract certain characteristics of the input signal, and played back shortly after, possibly slightly faster to catch up with the input sound. The algorithm is typically triggered by changes in the acoustic environment. The delay and catch up provide a multitude of novel possibilities in listening devices.

One possibility provided by the delay and catch up processing is to artificially move the sources that the audio processing device can separate but the user cannot, away from each other in the time domain. This requires that sources are already separated, e.g. with the algorithm described in [Pedersen et al., 2005]. The artificial time domain separation is achieved by delaying sounds that start while other sounds prevail until the previous (prevailing) sounds have finished.

Besides increased hearing thresholds, hearing impairment also includes decreased frequency selectivity (cf. e.g. [Moore, 1989]) and decreased release from forward masking (cf. e.g. [Oxenham, 2003]).

The latter observation indicates that in addition to a 'normal' forward masking delay $t_{md0}$ (implying an—ideally—beneficial minimum delay of $t_{md0}$ between the end of one sound and the beginning of the next (to increase intelligibility)), a hearing impaired person may experience an extra forward masking delay $\Delta t_{md}$ ($t_{md\text{-}hi}=t_{md0}+\Delta t_{md}$, $t_{md\text{-}hi}$ being the (minimum) forward masking delay of the hearing impaired person). Moore [Moore, 2007] reports that regardless of masking level, the masking decays to zero after 100-200 ms, suggesting the existence of a maximal forward masking release (implying that $t_{md\text{-}hi}\leq 200$ ms in the above notation). The additional delay increases the need for faster replay, such that the delayed sound can catch up with the input sound (or more accurately, with the minimally delayed output). The benefit of this modified presentation of the two sources is a decreased masking of the new sound by the previous sounds.

The algorithm specifies a presentation of separated sound sources regardless of the separation method being ICA (Independent Component Analysis), binary masks, microphone arrays, etc.

The same underlying algorithm (delay, (faster) replay) can also be used to overcome the problems with parameter estimation lagging behind the generator. If a generating parameter is changed (e.g. due to one or more of a change in speech characteristics, a new acoustic source appearing, a movement in the acoustic source, changes in the acoustic feedback situation, etc.) it takes some time before the estimator (e.g. some sort of 'algorithm or model implemented in a hearing aid to deal with such changes in generating parameters), i.e. an estimated parameter, converges to the new value. A proper handling of this delay or lag is an important aspect of the present invention. Often the delay is also a function of the scale of the parameter change, e.g. for algorithms with fixed or adaptive step sizes. In situations where parameters—extracted with a delay—are used to modify the signal, the time lag means that the output signal is not processed with the correct parameters in the time between the change of the generating parameters and the convergence of the estimated parameters. By saving (storing) the signal and replaying it with the converged parameters, the (stored) signal can be processed with the correct parameters. The delay introduced by the present method is thus not only adapted to compensate for a processing time of a particular algorithm but adapted to compensate for changes in the input signal. The delay introduced by the present method is induced by changes in the input signal (e.g. a certain characteristic, e.g. a parameter) and removed again when the input signal is stabilized. Further, by using a fast replay, the overall processing delay can be kept low.

In an anti-feedback setting the same underlying algorithm, (delay, faster replay) can be used to schedule the outputted sound in such a way that the howling is not allowed to build up. When the audio processing device detects that howling is building up, it silences the output for a short amount of time allowing the already outputted sound to travel past the microphones, before it replays the time-compressed delayed sound and catches up. Moreover the audio processing device will know that for the next, first time period the sound picked up by the microphones is affected by the output, and for a second time period thereafter it will be unaffected by the outputted sound. Here the duration of the first and second time periods depends on the actual device and application in terms of microphone, loudspeaker, involved distances and type of device, etc. The first and second time periods can be of any length in time, but are in practical situations typically of the order of ms (e.g. 0.5-10 ms).

It is an object of the invention to provide improvements in the processing of sounds in listening devices.

A Method

An object of the invention is achieved by a method of operating an audio processing device for processing an electric input signal representing an audio signal and providing a processed electric output signal. The method comprises, a) receiving an electric input signal representing an audio signal; b) providing an event-control parameter indicative of changes related to the electric input signal and for controlling the processing of the electric input signal; c) storing a representation of the electric input signal or a part thereof; d) providing a processed electric output signal with a configurable delay based on the stored representation of the electric input signal or a part thereof and controlled by the event-control parameter.

This has the advantage of providing a scheme for improving a user's perception of a processed signal.

The term an 'event-control parameter' is in the present context taken to mean a control parameter (e.g. materialized in a control signal) that is indicative of a specific event in the acoustic signal as detected via the monitoring of changes related to the input signal. The event-control parameter can be used to control the delay of the processed electric output signal. In an embodiment, the audio processing device (e.g. the processing unit) is adapted to use the event-control parameter to decide, which parameter of a processing algorithm or which processing algorithm or program is to be modified or exchanged and implemented on the stored representation of the electric input signal. In an embodiment, an <event> vs. <delay> table is stored in a memory of the audio processing device, the audio processing device being adapted to delay the processed output signal with the <delay> of the delay table corresponding to the <event> of the detected event-control parameter. In a further embodiment, an <event> vs. <delay> and <algorithm> table is stored in a memory of the audio processing device, the audio processing device being adapted to delay the processed output signal with the <delay> of the delay table corresponding to the <event> of the detected event-control parameter and to process the stored representation of the electric input signal according to the <algorithm> corresponding to the <event> and <delay> in question. Such a table stored in a memory of the audio processing device may alternatively or additionally include, corresponding parameters such as incremental replay rates <Δrate> (indicating an appropriate increase in replay rate compared to the 'natural' (input) rate), a typical <TYPstor> an/or maximum storage time <MAXstor> for a given type of <event> (controlling the amount of memory allocated to a particular event). Preferably, the event-control parameter is automatically extracted (i.e. without user intervention). In an embodiment, the event-control parameter is automatically extracted from the electric input signal and/or from local and/or remote detectors (e.g. detectors monitoring the acoustic environment).

The signal path from input to output transducer of a hearing instrument has a certain minimum time delay. In general, the delay of the signal path is adapted to be as small as possible. In the present context, the term 'the configurable delay' is taken to mean an additional delay (i.e. in excess of the minimum delay of the signal path) that can be appropriately adapted to the acoustic situation. In an embodiment, the configurable delay in excess of the minimum delay of the signal path is in the range from 0 to 10 s, e.g. from 0 ms to 100 ms, such as from 0 ms to 30 ms, e.g. from 0 ms to 15 ms. The actual delay at a given point in time is governed by the event-control parameter, which depends on events (changes) in the current acoustic environment.

The term 'a representation of the electric input signal' is in the present context taken to mean a—possibly modified—version of the electric input signal, the electric signal having e.g. been subject to some sort of processing, e.g. to one or more of the following: analog to digital conversion, amplification, directionality processing, acoustic feedback cancellation, time-to-frequency conversion, compression, frequency dependent gain modifications, noise reduction, source/signal separation, etc.

In a particular embodiment, the method further comprises e) extracting characteristics of the stored representation of the electric input signal; and f) using the characteristics to influence the processed electric output signal.

The term 'characteristics of the stored representation of the electric input signal' is in the present context taken to mean direction, signal strength, signal to noise ratio, frequency spectrum, onset or offset (e.g. the start and end time of an acoustic source), modulation spectrum, etc.

In an embodiment, the method comprises monitoring changes related to the input audio signal and using detected changes in the provision of the event-control parameter. In an embodiment, such changes are extracted from the electrical input signal (possibly from the stored electrical input signal). In an embodiment, such changes are based on inputs from other sources, e.g. from other algorithms or detectors (e.g. from directionality, noise reduction, bandwidth control, etc.). In an embodiment, monitoring changes related to the input audio signal comprises evaluating inputs from local and or remotely located algorithms or detectors, remote being taken to mean located in a physically separate body, separated by a physical distance, e.g. by >1 cm or by >5 cm or by >15 cm or by more than 40 cm.

The term 'monitoring changes related to the input audio signal' is in the present context taken to mean identifying changes that are relevant for the processing of the signal, i.e. that might incur changes of processing parameters, e.g. related to the direction and/or strength of the acoustic signal(s), to acoustic feedback, etc., in particular such parameters that require a relatively long time constant to extract from the signal (relatively long time constant being e.g. in the order of ms such as in the range from 5 ms-1000 ms, e.g. from 5 ms to 100 ms, e.g. from 10 ms to 40 ms).

In an embodiment, the method comprises converting an input sound to an electric input signal.

In an embodiment, the method comprises presenting a processed output signal to a user, such signal being at least partially based on the processed electric output signal with a configurable delay.

In an embodiment, the method comprises processing a signal originating from the electric input signal in a parallel signal path without additional delay. The term 'parallel' is in the present context to be understood in the sense that at some instances in time, the processed output signal may be based solely on a delayed part of the input signal and at other instances in time, the processed output signal may be based solely on a part of the signal that has not been stored (and thus not been subject to an additional delay compared to the normal processing delay), and in yet again other instances in time the processed output signal may be based on a combination of the delayed and the undelayed signals. The delayed and the undelayed parts are thus processed in parallel signal paths, which may be combined or independently selected, controlled at least in part by the event control parameter (cf. e.g. FIG. 1*a*). In an embodiment, the delayed and undelayed signals are subject to the same processing algorithm(s).

In an embodiment, the method comprises a directionality system, e.g. comprising processing input signals from a number of different input transducers whose electrical input signals are combined (processed) to provide information about the spatial distribution of the present acoustic sources. In an embodiment, the directionality system is adapted to separate the present acoustic sources to be able to (temporarily) store an electric representation of a particular one (or one or more) in a memory (e.g. of hearing instrument). In an embodiment, a directional system (cf. e.g. EP 0 869 697), e.g. based on beam forming (cf. e.g. EP 1 005 783), e.g. using time frequency masking, is used to determine a direction of an acoustic source and/or to segregate several acoustic source signals originating from different directions (cf. e.g. [Pedersen et al., 2005]).

The term 'using the characteristics to influence the processed electric output signal' is in the present context taken to mean to adapt the processed electric output signal using algorithms with parameters based on the characteristics extracted from the stored representation of the input signal.

In an embodiment, a time sequence of the representation of the electric input signal of a length of more than 100 ms, such as more than 500 ms, such as more than 1 s, such as more than 5 s can be stored (and subsequently replayed). In an embodiment, the memory has the function of a cyclic buffer (or a first-in-first-out buffer) so that a continuous recordal of a signal is performed and the first stored part of the signal is deleted when the buffer is full.

In an embodiment, the storing of a representation of the electric input signal comprises storing a number of time frames of the input signal each comprising a predefined number N of digital time samples $x_n$ (n=1, 2, . . . , N), corresponding to a frame length in time of $L=N/f_s$, where $f_s$ is a sampling frequency of an analog to digital conversion unit. In an embodiment, a time to frequency transformation of the stored time frames on a frame by frame basis is performed to provide corresponding spectra of frequency samples. In an embodiment, a time frame has a length in time of at least 8 ms, such as at least 24 ms, such as at least 50 ms, such as at least 80 ms. In an embodiment, the sampling frequency of an analog to digital conversion unit is larger than 4 kHz, such as larger than 8 kHz, such as larger than 16 kHz.

In an embodiment, the configurable delay is time variant. In an embodiment, the time dependence of the configurable delay follows a specific functional pattern, e.g. a linear dependence, e.g. decreasing. In a preferred embodiment, the processed electric output signal is played back faster (than the rate with which it is stored or recorded) in order to catch up with the input sound (thereby reflecting a decrease in delay with time). This can e.g. be implemented by changing the number of samples between each frame at playback time. Sanjune refers to this as Granulation overlap add [Sanjune, 2001]. Furthermore Sanjune [Sanjune, 2001] describe several improvements, e.g., synchronized overlap add (SOLA), pitch synchronized overlap add (PSOLA), etc., to the basic technique that might be useful in this context. Additionally, pauses between words just like the stationary parts of vowel parts can be time compressed simply by utilizing the redundancy across frames.

In an embodiment, the electrical input signal has been subject to one or more (prior) signal modifying processes. In an embodiment, the electrical input signal has been subject to one or more of the following processes noise reduction, speech enhancement, source separation, spatial filtering, beam forming. In an embodiment, the electric input signal is a signal from a microphone system, e.g. from a microphone system comprising a multitude of microphones and a directional system for separating different audio sources. In a particular embodiment, the electric input signal is a signal from a directional system comprising a single extracted audio source. In an embodiment, the electrical input signal is an AUX input, such as an audio output of an entertainment system (e.g. a TV- or HiFi- or PC-system) or a communications device. In an embodiment, the electrical input signal is a streamed audio signal.

In an embodiment, the algorithm is used as a pre-processing for an ASR (Automatic Speech Recognition) system.

Re-Scheduling of Sounds:

In an embodiment, the delay is used to re-schedule (parts of) sound in order for the wearer to be able to segregate sounds. The problem that this embodiment of the algorithm aims at solving is that a hearing impaired wearer cannot segregate in the time-frequency-direction domain as good as normally hearing listeners. The algorithm exaggerates the time-frequency-direction cues in concurrent sound sources in order to achieve a time-frequency-direction segregation that the wearer is capable of utilizing. Here the lack of frequency and/or spatial resolution is circumvented by introducing or exaggerating temporal cues. The concept also works for a single microphone signal, where the influence of limited spectral resolution is compensated by adding or exaggerating temporal cues.

In an embodiment, 'monitoring changes related to the input sound signal' comprises detecting that the electric input signal represents sound signals from two spatially different directions relative to a user, and the method further comprises separating the electric input signal in a first electric input signal representing a first sound of a first duration from a first start-time to a first end-time and originating from a first direction, and a second electric input signal representing a second sound of a second duration from a second start-time to a second end-time originating from a second direction, and wherein the first electric input signal is stored and a first processed electric output signal is generated there from and presented to the user with a delay relative to a second processed electric output signal generated from the second electric input signal.

In an embodiment, the configurable delay includes an extra forward masking delay to ensure an appropriate delay between the end of a first sound and the start of a second sound. Such delay is advantageously adapted to a particular user's needs. In an embodiment, the extra forward masking delay is larger than 10 ms, such as in the range from 10 ms to 200 ms.

In an embodiment, the method is combined with "missing data algorithms" (e.g. expectation-maximization (EM) algorithms used in statistical analysis for finding estimates of parameters), in order to fill-in parts occluded by other sources in frequency bins that are available at a time of presentation.

Within the limits of audiovisual integration, different delays can be applied to different, spatially separated sounds. The delays are e.g. adapted to be time-varying, e.g. decaying, with an initial relatively short delay that quickly diminishes to zero—i.e. the hearing instrument catches up.

With beam forming, sounds of different spatial origin can be separated. With binary masks we can asses the interaction/masking of competing sounds. With an algorithm according to an embodiment of the invention, we initially delay sounds from directions without audiovisual integration (i.e. from sources which cannot be seen by the user, e.g. from behind and thus, where a possible mismatch between audio and visual impressions is less important) in order to obtain less interaction between competing sources. This embodiment of the invention is not aimed for a speech-in-noise environment but rather for speech-on-speech masking environments like the cocktail party problem.

The algorithm can also be utilized in the speak'n'hear setting where it can allow the hearing aid to gracefully recover from the mode shifts between speak and hear gain rules. This can e.g. be implemented by delaying the onset (start) of a speakers voice relative to the offset (end) of the own voice, thereby compensating for forward masking.

The algorithm can also be utilized in a feedback path estimation setting, where the "silent" gaps between two concurrent sources is utilized to put inaudible (i.e. masked by the previous output) probe noise out through the HA receiver and subsequent feedback path.

The algorithms can also be utilized to save the incoming sound, if the feedback cancellation system decides that the output has to be stopped now (and replayed with a delay) in order to prevent howling (or similar artefacts) due to the acoustic coupling.

An object of this embodiment of the invention is to provide a scheme for improving the intelligibility of spatially separated sounds in a multi speaker environment for a wearer of a listening device, such as a hearing instrument.

In a particular embodiment, the electric input signal representing a first sound of a first duration from a first start-time to a first end-time and originating from a first direction is delayed relative to a second sound of a second duration from a second start-time to a second end-time and originating from a second direction before being presented to a user.

This has the advantage of providing a scheme for combining and presenting multiple acoustic source-signals to a wearer of a listening device, when the source signals originate from different directions In a particular embodiment, the first direction corresponds to a direction without audiovisual integration, such as from behind the user. In a particular embodiment, the second direction corresponds to a direction with audiovisual integration, such as from in front of the user.

In a particular embodiment, a first sound begins while a second sound exists and wherein the first sound is delayed until the second sound ends at the second end-time, the hearing instrument being in a delay mode from the first start-time to the second end-time. In a particular embodiment, the first sound is temporarily stored, at least during its coexistence with the second sound.

In a particular embodiment, the first stored sound is played for the user when the second sound ends. In a particular embodiment, the first sound is time compressed, when played for the user. In a particular embodiment, the first sound is being stored until the time compressed replay of the first sound has caught up with the real time first sound, from which instance the first sound signal is being processed normally.

In an embodiment, the first sound is delayed until the second sound ends at the second end-time plus an extra forward masking delay time $t_{md}$ (e.g. adapted to a particular user's needs).

In a particular embodiment, the time-delay of the first sound signal is minimized by combination with a frequency transposition of the signal. This embodiment of the algorithm generalizes to a family of algorithms where small non-linear transformations are applied in order to artificially separate sound originating from different sources in both time and/or frequency. Two commonly encountered types of masking are 1) forward masking, where a sound masks another sound right after (in the same frequency region) and 2) upwards spread of masking, where a sound masks another sound at frequencies close to and above the sound. The delay and fast replay can help with the forward masking, and the frequency transposition can be used to help with the upper spread of masking. In an embodiment, the first sound or sound component is transposed in frequency to utilize a faster release from masking. In an embodiment, the transposition is based on a model of the human auditory system. In an embodiment, the model of the human auditory system (in particular the masking threshold vs. frequency) is customized to the hearing impairment of a particular user. Essentially, it is the shape of the masking template spectrum that determines the necessary amount of transposition to make the first sound or sound component audible. A positive effect of the minimized delay is that the combined extension of the masking due to the first and first sound components is minimized as well.

In a particular embodiment, the separation of the first and second sounds are based on the processing of electric output signals of at least two input transducers for converting acoustic sound signals to electric signals, or on signals originating there from, using a time frequency masking technique (c.f. Wang [Wang, 2005]) or an adaptive beamformer system.

In a particular embodiment, each of the electric output signals from the at least two input transducers are digitized and arranged in time frames of a predefined length in time, each frame being converted from time to frequency domain to provide a time frequency map comprising successive time frames, each comprising a digital representation of a spectrum of the digitized time signal in the frame in question (each frame consisting of a number of TF-units).

In a particular embodiment, the time frequency maps are used to generate a (e.g. binary) gain mask for each of the signals originating from the first and second directions allowing an assessment of time-frequency overlap between the two signals.

An embodiment of the invention comprises the following elements:

- With beam forming sounds of different spatial origin can be separated.
- With binary masks the interaction/masking of competing sounds can be assessed.
- Comparison of two different spatial directions enables the assessment of the time-frequency overlap between the two signals.

Different Amplification of Different Voices, Speak and Hear Situation:

In an embodiment, the algorithm is adapted to use raw microphone inputs, spatially filtered, estimated sources or speech enhanced signals, the so-called 'speak and hear' situation. Here, the problem addressed with the embodiment of the algorithm is to address the need for different amplification for different sounds. The so called "Speak and Hear" situation is commonly known to be problematic for hearing impaired since the need for amplification is quite different for own voice vs. other peoples voice. Basically, the problem solved is equivalent to the re-scheduling of sounds described above, with 'own voice' treated as a "direction".

In a particular embodiment, the (own) voice of the user is separated from other acoustic sources. In an embodiment, a first electric input signal represents an acoustic source other than a user's own voice and a second electric input signal represents a user's own voice. In an embodiment, the amplification of the stored, first electric signal is appropriately adapted before being presented to the user. The same benefits will be provided when following the conversation of two other people where different amount of amplification has to be applied to the two speakers. Own voice detection is e.g. dealt with in US 2007/009122 and in WO 2004/077090.

Estimation of Parameters that Require Relatively Long Estimation Times:

Besides from the normal bias and variance associated with a comparison of a generative parameter and an estimated parameter, the estimation furthermore suffers from an estimation lag, i.e., that the manifestation of a parameter change in the observable data is not instantaneous. Often bias and variance in an estimator can be minimized by allowing a longer estimation time. In hearing instruments the throughput delay has to be small (cf. e.g. [Laugesen, Hansen, and Hellgren, 1999; Prytz, 2004]), and therefore improving estimation accuracy by allowing longer estimation time is not commonly advisable. It boils down to how many samples that the estimator needs to "see" in order to provide an estimate with the necessary accuracy and robustness. Furthermore, a longer estimation time is only necessary in order to track relatively large parameter changes. The present algorithm provides an opportunity to use a relatively short estimation time most of the time (when generating parameters are almost constant), and a relatively longer estimation time when the generating parameters change, while not compromising the overall throughput delay. When a large scale parameter change occurs, e.g. considerably larger than the step-size of the estimating algorithm, if such parameter is defined, the algorithm saves the sound until the parameter estimations have converged—then the recorded sound is processed with the converged parameters and replayed with the converged parameters, possibly played back faster (i.e. with a faster rate than it is stored or recorded) in order to catch up with the input sound. In an embodiment, the method comprises that the delay introduced by the storage of the electric input sound signal is removed (except for the normal processing delay between input and output), when the parameters have converged and the output signal has caught up with the input signal.

In an embodiment, the algorithm is adapted to provide modulation filtering. In modulation filtering (cf. e.g. [Schimmel, 2007; Atlas, Li, and Thompson, 2004]) the modulation in a band is estimated from the spectrum of the absolute values in the band. The modulation spectrum is often obtained using double filtering (first filtering full band signal to obtain the channel signal, and then the spectrum can be obtained by filtering the absolute values of the channel signals). In order to obtain the necessary modulation frequency resolution a reasonable number of frames each consisting of a reasonable number of samples has to be used in the computation of the modulation spectrum. The default values in Athineos' modulation spectrum code provide insight in what 'a reasonable number' means in terms of modulation spectrum filtering (cf. [Athineos]). Athineos suggested that 500 ms of signal was used to compute each modulation spectrum, with an update rate of 250 ms, and moreover that each frame was 20 ms long. However, a delay of 250 ms or even 125 ms heavily exceeds the hearing aid delays suggested by Laugesen or Prytz [Laugesen et al. 1999; Prytz 2004]. Given the target modulation frequencies, Schimmel and Atlas have suggested using a bank of time-varying second order IIR resonator filters in order to keep the delay of the modulation filtering down [Schimmel and Atlas, 2008].

The delay and fast replay algorithm allows the modulation filtering parameters to be estimated with greater accuracy using a longer delay than suggested by Laugesen or Prytz [Laugesen et al. 1999; Prytz 2004] and at the same time benefit from the faster modulation filtering with time-varying second order IIR resonator filters suggested by Shimmel and Atlas [Shimmel and Atlas 2008].

In an embodiment, the algorithm is adapted to provide spatial filtering. In adaptive beam forming the spatial parameters are estimated from the input signals, consequently when sound in a new direction (one that was not active before) is detected, the beam former is not tuned in that direction. By continuously saving the input signals, the beginning of sound from that direction can be spatially filtered with the converged spatial parameters, and as the spatial parameters remain stable the additional delay due to this algorithm is decreased until it has caught up with the input sound.

An Audio Processing Unit

In a further aspect, an audio processing device is provided by the present invention. The audio processing device comprises a receiving unit for receiving an electric input signal representing an audio signal, a control unit for generating an event-control signal, a memory for storing a representation of the electric input signal or a part thereof, the audio processing device comprising a signal processing unit for providing a processed electric output signal based on the stored representation of the electric input signal or a part thereof with a configurable delay controlled by the event-control signal.

It is intended that the process features of the method described above, in the detailed description of 'mode(s) for carrying out the invention' and in the claims can be combined with the device, when appropriately substituted by a corresponding structural feature. Embodiments of the device have the same advantages as the corresponding method.

In general the signal processing unit can be adapted to perform any (digital) processing task of the audio processing device. In an embodiment, the signal processing unit comprises providing frequency dependent processing of an input signal (e.g. adapting the input signal to a user's needs). Additionally or alternatively, the signal processing unit may be adapted to perform one or more other processing tasks, such as selecting a signal among a multitude of signals, combining a multitude of signals, analyze data, transform data, generate control signals, write data to and/or read data from a memory, etc. A signal processing unit can e.g. be a general purpose digital signal processing unit (DSP) or such unit specifically adapted for audio processing (e.g. from AMI, Gennum or Xemics) or a signal processing unit customized to the particular tasks related to the present invention.

In an embodiment, the signal processing unit is adapted for extracting characteristics of the stored representation of the electric input signal. In an embodiment, the signal processing unit is adapted to use the extracted characteristics to generate or influence the event-control signal and/or to influence the processed electric output signal (e.g. to modify its gain, compression, noise reduction, incurred delay, use of processing algorithm, etc.).

In an embodiment, the audio processing device is adapted for playing the processed electric output signal back faster than it is recorded in order to catch up with the input sound.

In an embodiment, the audio processing device comprises a directionality system for localizing a sound in the user's environment at least being able to discriminate a first sound originating from a first direction from a second sound originating from a second direction, the signal processing unit being adapted for delaying a sound from the first direction in case it occurs while a sound from the second direction is being presented to the user.

In a particular embodiment, the directionality system for localizing a sound in the user's environment is adapted to be based on a comparison of two binary masks representing sound signals from two different spatial directions and providing an assessment of the time-frequency overlap between the two signals.

In a particular embodiment, the audio processing device comprises a frequency transposition unit for minimizing a time-delay of a first sound component of the electric input signal relative to a second, previous sound component of the electric input signal by transposing the first sound component in frequency to a frequency range having a faster release from masking. In a particular embodiment, the audio processing device is adapted to provide that the time-delay of the first sound signal can be minimized by combination with a frequency transposition of the signal. In an embodiment, the audio processing device is adapted to provide that the first sound or sound component is transposed in frequency to utilize a faster release from masking. In an embodiment, the audio processing device is adapted to provide that the transposition is based on a model of the human auditory system. In an embodiment, the audio processing device is adapted to provide that the model of the human auditory system (in particular the masking threshold vs. frequency) is customized to the hearing impairment of a particular user.

In a particular embodiment, the audio processing device comprises a monitoring unit for monitoring changes related to the input sound and for providing an input to the control unit. Monitoring units for monitoring changes related to the input sound e.g. for identifying different acoustic environments are e.g. described in WO 2008/028484 and WO 02/32208.

In a particular embodiment, the audio processing device comprises a signal processing unit for processing a signal originating from the electric input signal in a parallel signal path without additional delay so that a processed electric output signal with a configurable delay and a, possibly differently, processed electric output signal without additional delay are provided. In an embodiment, the processing algorithm(s) of the parallel signal paths (delayed and undelayed) are the same.

In a particular embodiment, the audio processing device comprises more than two parallel signal paths, e.g. one providing undelayed processing and two or more providing delayed processing of different electrical input signals (or processing of the same electrical input signal with different delays).

In a particular embodiment, the audio processing device comprises a selector/combiner unit for selecting one of a weighted combination of the delayed and the undelayed processed electric output signals, at least in part controlled by the event control signal.

A Listening System

In a further aspect, a listening system, e.g. a hearing aid system adapted to be worn by a user, is provided, the listening system comprising an audio processing device as described above, in the detailed description of 'mode(s) for carrying out the invention' and in the claims and an input transducer for converting an input sound to an electric input signal. Alternatively, the listening system can be embodied in an active ear protection system, a head set or a pair of ear phones. Alternatively, the listening system can form part of a communications device. In an embodiment, the input transducer is a microphone. In an embodiment, the input transducer is located in a part physically separate from the part wherein the audio processing device is located.

In an embodiment, the listening system comprises an output unit, e.g. an output transducer, e.g. a receiver, for adapting the processed electric output signal to an output stimulus appropriate for being presented to a user and perceived as an audio signal. In an embodiment, the output transducer is located in a part physically separate from the part wherein the audio processing device is located. In an embodiment, the output transducer form part of a PC-system or an entertainment system comprising audio. In an embodiment, the listening system comprises a hearing instrument, an active ear plug or a head set.

A Data Processing System

In a further aspect, a data processing system comprising a signal processor and a software program code for running on the signal processor, is provided wherein the software program code—when run on the data processing system—causes the signal processor to perform at least some (such as a majority, such as all) of the steps of the method described above, in the detailed description of 'mode(s) for carrying out the invention' and in the claims. In an embodiment, the signal processor comprises an audio processing device as described above, in the detailed description of 'mode(s) for carrying out the invention' and in the claims. In an embodiment, the data processing system form part of a PC-system or an entertainment system comprising audio. In an embodiment, the data processing system form part of an ASR-system. In an embodiment, the software program code of the present invention form part of or is embedded in a computer program form handling voice communication, such as Skype™ or Gmail Voice™.

A Computer Readable Medium

In a further aspect, a medium having software program code comprising instructions stored thereon is provided, that when executed on a data processing system, cause a signal processor of the data processing system to perform at least some (such as a majority, such as all) of the steps of the method described above, in the detailed description of 'mode(s) for carrying out the invention' and in the claims. In an embodiment, the signal processor comprises an audio processing device as described above, in the detailed description of 'mode(s) for carrying out the invention' and in the claims.

Further objects of the invention are achieved by the embodiments defined in the dependent claims and in the detailed description of the invention.

As used herein, the singular forms "a," "an," and "the" are intended to include the plural forms as well (i.e. to have the meaning "at least one"), unless expressly stated otherwise. It will be further understood that the terms "includes," "comprises," "including," and/or "comprising," when used in this specification, specify the presence of stated features, integers, steps, operations, elements, and/or components, but do not preclude the presence or addition of one or more other features, integers, steps, operations, elements, components, and/or groups thereof. It will be understood that when an element is referred to as being "connected" or "coupled" to another element, it can be directly connected or coupled to the other element or intervening elements maybe present, unless expressly stated otherwise. Furthermore, "connected" or "coupled" as used herein may include wirelessly connected or coupled. As used herein, the term "and/or" includes any and all combinations of one or more of the associated listed items. The steps of any method disclosed herein do not have to be performed in the exact order disclosed, unless expressly stated otherwise.

BRIEF DESCRIPTION OF DRAWINGS

The invention will be explained more fully below in connection with a preferred embodiment and with reference to the drawings in which.

Figure 1A:
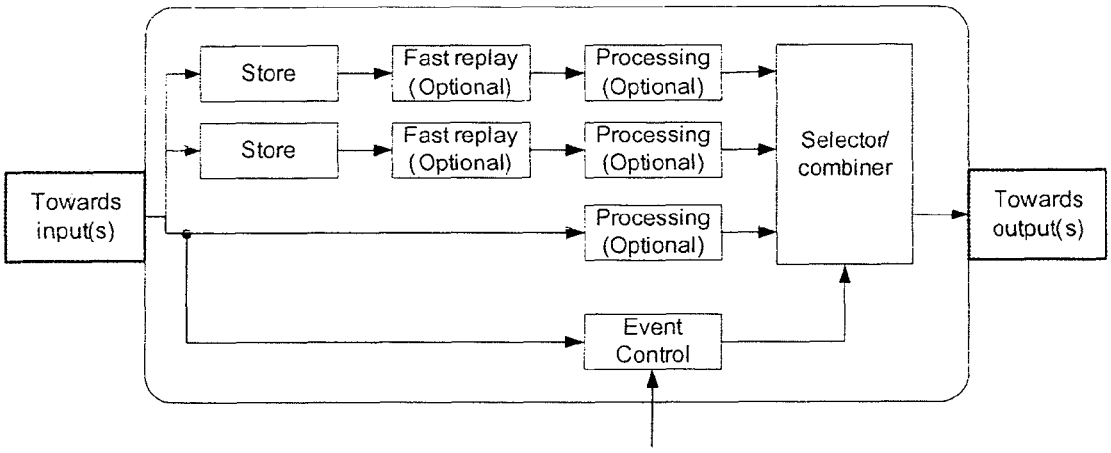
FIG. 1 illustrates the general concept of a method according to the invention, FIG. 1*a* showing a parallel embodiment of two instances of the general algorithm, and FIG. 1*b* showing an embodiment of the algorithm with various inputs.

The figures are schematic and simplified for clarity, and they just show details which are essential to the understanding of the invention, while other details are left out.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

MODE(S) FOR CARRYING OUT THE INVENTION

Current hearing instrument configuration with two or more microphones on each ear and wireless communication allows for quite advanced binaural signal processing techniques.

Pedersen and colleagues [Pedersen et al., 2005; Pedersen et al., 2006] and have shown how Independent Components Analysis (ICA) or time-frequency masking can be combined with well known adaptive beamforming to provide access to multiple sources in the time-frequency-direction domain. This extends the work, where it was shown that independent signals are disjoint in the time-frequency domain.

The following notation is used for the transformation of a signal representation in the time domain (s(t)) to a signal representation in the (time-)frequency domain (s(t,f)) (comprising frequency spectra for the signal in consecutive time frames)

$$S_{dir}(t) \xleftrightarrow{\text{STFT}} S_{dir}(t,f),$$

where s is the source signal, t is time, f is frequency, STFT is Short Time Fourier Transformation, dir is an optional direction that can also be a number. Noise signals are denoted n. Here a Short Time Fourier Transformation has been used to split the signal into a number of frequency dependent channels, nevertheless any other type of filterbank, e.g. gammatone, wavelet or even just a pair of single filters can be used. Changing the filterbank only changes the time-frequency or related properties—not the direct functionality of the masks.

Ideal Binary Mask

In the definition of the ideal binary masks the absolute value of a time-frequency (TF) bin is compared to the corresponding (in time and frequency) TF bin of the noise. If the absolute value in the TF bin of the source signal is higher than the corresponding TF noise bin, that bin is said to belong to the source signal [Wang, 2005]. Finally the source signal (as well as the noise signal) can be reconstructed by synthesizing the subset of TF-bins that belong to the source signal.

Basically the real or complex value in the TF bin is multiplied with a one if the TF-bin belongs to the signal and a zero if it does not.

$$\hat{S}(t,f) = S(t,f)bm(t,f)$$

$$bm(t,f) = \begin{cases} 1, & S(t,f) \geq N(t,f) + LC \\ 0, & S(t,f) < N(t,f) + LC, \end{cases}$$

in the following LC (the so called Local Criterion) is set to zero for simplicity, c.f. [Wang et al., 2008] for further description of the properties of the Local Criterion.

The ideal binary mask cannot, however, be used in realistic settings, since we do not have access to the clean source signal or noise signal.

Beyond the Ideal Binary Mask

In his NIPS 2000 paper [Roweis, 2001] showed how Factorial Hidden Markov Chains could be applied to separate two speakers in the TF-domain from a single microphone recording. Each Factorial Hidden Markov Chain was trained using a selection of the specific speakers in quiet.

The need for specific knowledge of the two speakers in form of the individually trained Factorial Hidden Markov Chains was necessary in order to be able to separate the two speakers. Primarily due to memory constraints, the requirement of speaker specific models is not attractive for current HA's.

The specific speaker knowledge can be replaced by spatial information that provides the measure that can be used to discriminate between multiple speakers/sounds [Pedersen et al., 2006; Pedersen et al., 2005]. Given any spatial filtering algorithm, e.g., a delay-and-sum beamformer or more advanced setups, outputs filtered in different spatial directions can be compared in the TF-domain, like the signal and noise for the ideal binary masks, in order to provide a map of the spatial and spectral distribution of current signals.

$$\hat{S}_{left}(t, f) = S_{left}(t, f)bm_{left}(t, f)$$

$$\hat{S}_{right}(t, f) = S_{right}(t, f)(1 - bm_{left}(t, f))$$

$$bm_{left}(t, f) = \begin{cases} 1, & S_{left}(t, f) \geq S_{right}(t, f) \\ 0, & S_{left}(t, f) < S_{right}(t, f) \end{cases}$$

If left and right are interchanged with front and rear, the above equations describe the basic for the monaural Time Frequency Masking.

The comparison of two binary masks from two different spatial directions allows us to asses the time-frequency overlap between the two signals. If one of these signals originates from behind (the rear-sound) where audiovisual misalignment is not a problem the time-frequency overlap between the two signals can be optimized by saving the rear signal until the overlap ends, and then the rear signal is replayed in a time-compressed manner until the delayed sound has caught up with the input.

The necessary time-delay can be minimized by combining it with slight frequency transposition. Then the algorithm generalizes to a family of algorithms where small non-linear transformations are applied in order to artificially separate the time-frequency bins originating from different sources.

A test that assesses the necessary glimpse size (in terms of frequency range and time-duration) of the hearing impaired (cf. e.g. [Cooke, 2006]) would tell the algorithm to know how far in frequency and/or time that the saved sound should be translated in order to help the individual user. A glimpse is part of a connected group (neighbouring in time or frequency) of time-frequency bins belonging to the same source. The term auditory glimpse is an analogy to the visual phenomenon of glimpses where objects can be identified from partial information, e.g. due to objects in front of the target. Bregman [Bregman, 1990] provides plenty of examples of that kind. With regard to hearing, the underlying structure that interconnects time-frequency bins such as a common onset, continuity, a harmonic relation, or say a chirp can be identified and used even though many time-frequency bins are not dominated by other sources. Due to decreased frequency selectivity and decreased release from masking it seems that glimpses need to be larger for listeners with hearing impairment.

Another concept related to the glimpses, is listening in the dips. Compared to the setting with a static masker (background or noise signal), the hearing impaired do not benefit from a modulated masker to the same degree as normally hearing do. It can be viewed as if the hearing impaired, due to their decreased frequency selectivity and release from masking, cannot access the glimpses of the target in the dips that the modulated masker provides. Thus hearing impairment yields that those glimpses has to be larger or more separated from the noise for the hearing impaired than for normal hearing (cf. [Oxenham et al., 2003] or [Moore, 1989]). In an embodiment of the invention, the method or audio processing device is adapted to identify glimpses in the electrical input signal and to enhance such glimpses or to separate such glimpses from noise in the signal.

For the speak'n'hear application a decaying delay allows the hearing instrument to catch up on the shift, amplify the "whole utterance" with the appropriate gain rule (typically lower gain for own voice than other voices or sounds)—and since the frequency of which the conversation goes back and forth is not that fast, we don't expect the users to become 'sea-sick' of the changing delays. This processing is quite similar to the re-scheduling of sounds from different directions, it just extends direction characteristic with the non-directional internal location of the own voice.

Figure 1B:
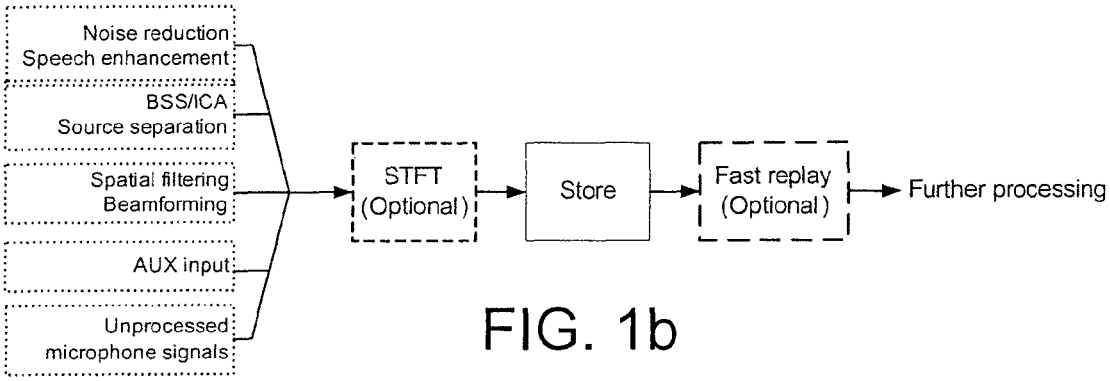

FIG. 1 shows two examples of partial processing paths with the storage and (fast) replay algorithm. FIG. 1*a* shows an example of a parallel processing path with two storage, fast replay paths and an undelayed path. The output of the overall Event Control (e.g. an event-control parameter) specifies how the Selector/combiner should combine the signals in the parallel processing paths in order to obtain an optimized output. The selector/combiner may select one of the input signals or provide a combination of two or more of the input signals, possible appropriately mutually weighted. FIG. 1*b* shows common audio device processing as pre-processing steps before the storage and (fast) replay algorithm. One or more of the exemplary possible pre-processing steps of FIG. 1*b* may be/have been applied on the electrical input signal prior to its input to the present algorithm (or audio processing device) include noise reduction, speech enhancement, acoustic source separation (e.g. based on BSS or ICA), spatial filtering, beamforming. The electrical input signal may additionally or alternatively comprise an AUX input from an entertainment device or any other communication device. Alternatively or additionally the electrical input signal may comprise unprocessed (electric, possibly analogue or alternatively digitized) microphone signals. Obviously the storage, fast replay can also be integrated in the algorithms mentioned in the figure. Moreover, the figure exemplifies an embodiment where the storage, fast replay is used to re-schedule the signals from more or many of the mentioned inputs or signal extraction algorithms.

Figure 2:
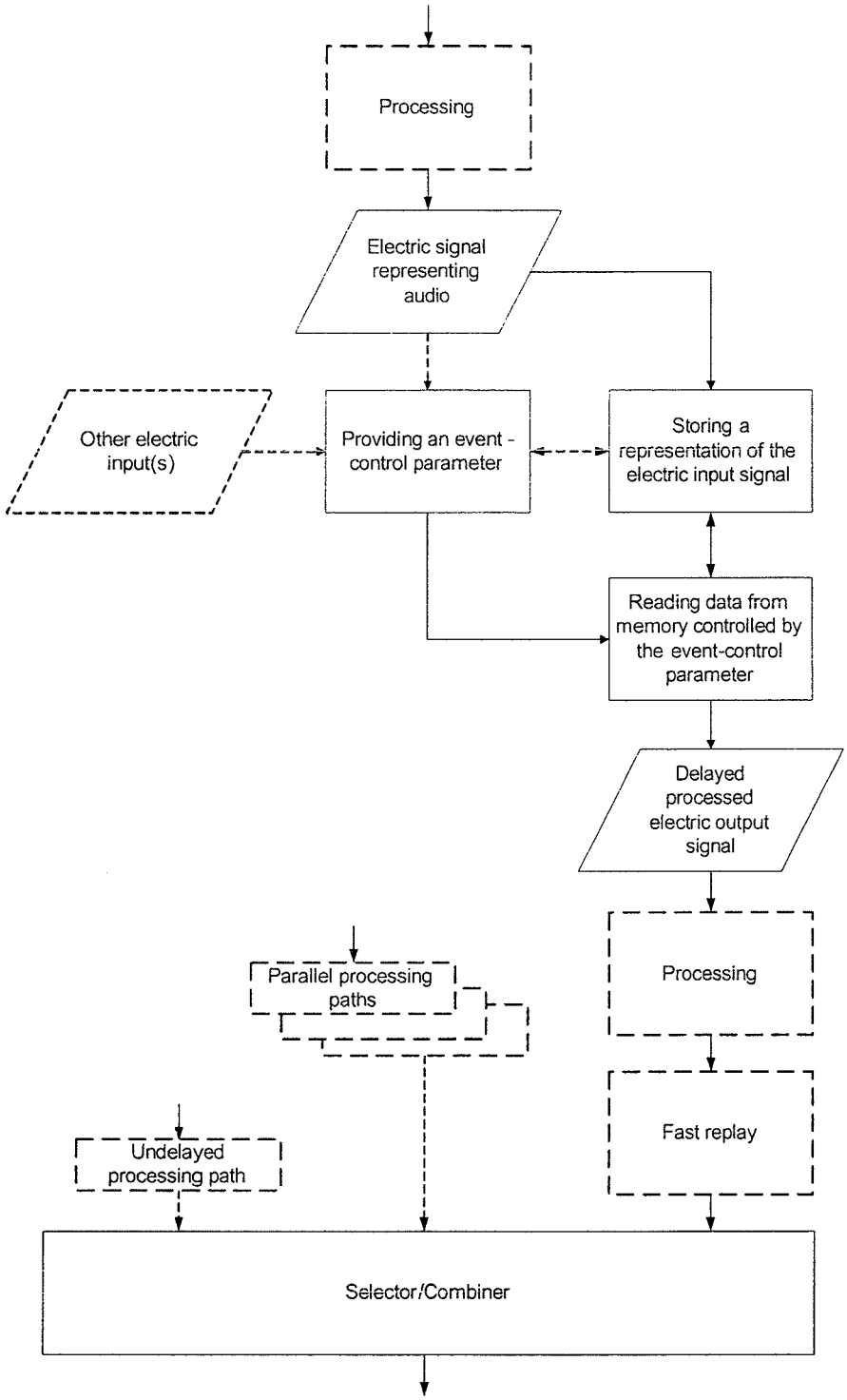
FIG. 2 shows a more detailed description of the general algorithm.

FIG. 2 shows an example of the internal structure of the presented algorithm. An event control parameter (step Providing an event-control parameter) is extracted from either the specific electric signal (input Electric signal representing audio) to be processed with the algorithm, or from other electrical inputs (input Other electric input(s)), or from the stored representation of the specific electric signal to be processed with the algorithm (available from step Storing a representation of the electric input signal). Examples of such an event control parameter can be seen in FIG. 4*a*-4*f*, e.g., parameters that define the start and end of sound objects, or the time where a new sound source appears along with the time where the parameters describing that source has converged. Moreover, an event control parameter can also be associated with events that define times where something happens in the sound, e.g. times where the use of the storage and (fast) replay algorithm is advantageous for the user of an audio device. When the algorithm is ready to replay the stored signal it begins reading data from the memory (step Reading data from memory controlled by the event-control parameter)—generating a delayed version of the stored (possibly processed) electric input signal (output Delayed processed electric output signal)—that can be processed (optional step Processing) and the delay can be recovered in the optional fast replay step (step Fast replay). Finally the signal can optionally be combined in the Selector/Combiner step with other signals that have been through a parallel storage and (fast) replay path (step Parallel processing paths) or the Undelayed processing path. In the selector/combiner step—based at least partially on an event-control parameter input—one of the input signals may be selected and presented as an output. Alternatively, a combination of two or more of the input signals, possibly appropriately mutually weighted, may be provided, and presented as an output. In an embodiment, the Selector/Combiner step comprises selecting between at least one delayed processed output signal and an undelayed processed output signal. Dashed lines indicate optional inputs, connections or steps/processes (functional blocks). Such optional items may e.g. include further parallel paths (steps Parallel processing paths) comprising similar or alternative processing steps of the electric input signal (or apart thereof) to the ones mentioned. Alternatively or additionally, such optional items may include a processing path comprising an undelayed ('normal') processing path (step Undelayed processing path) of the electric input signal (or apart thereof).

Figure 3:
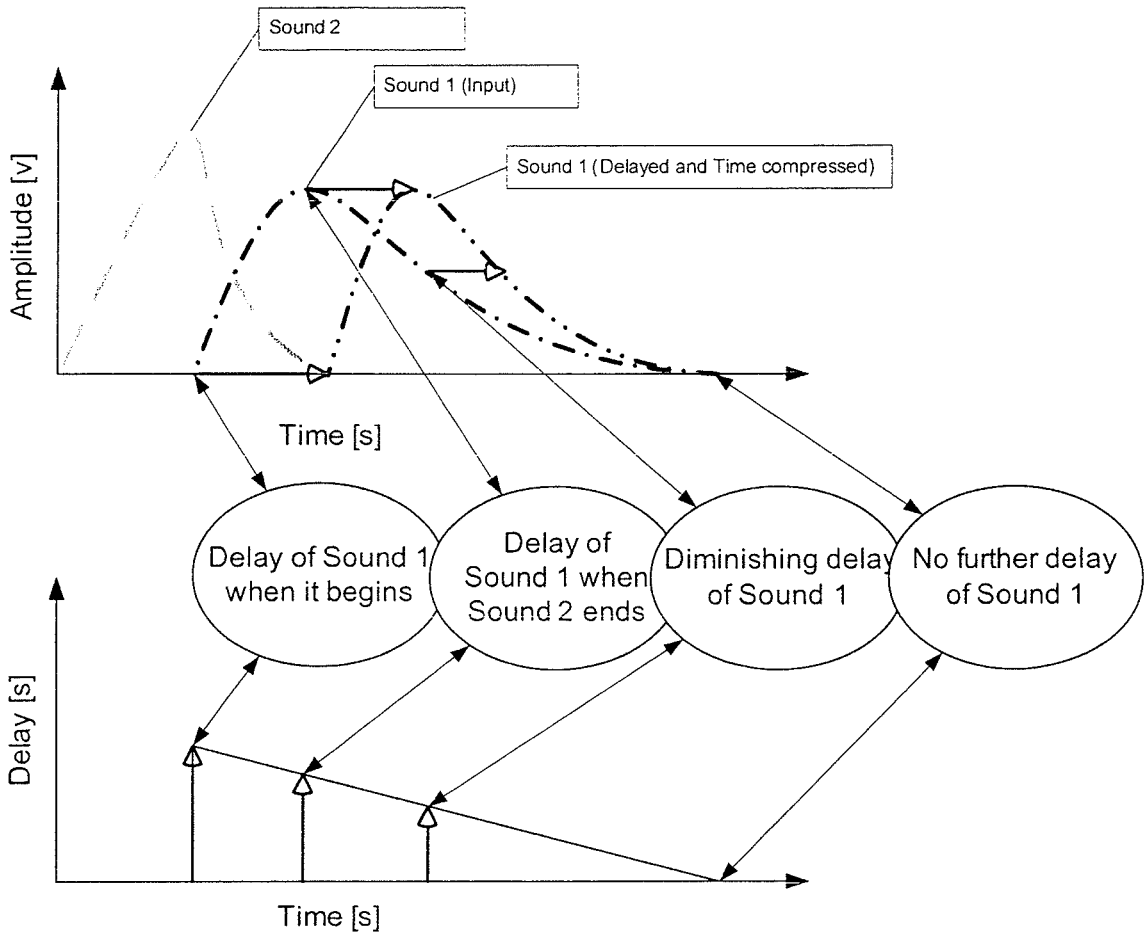
FIG. 3 illustrates the delay concept of presentation to a user of a first (rear) signal source when occurring simultaneously with a second (front) signal source of a method according to an embodiment of the invention.

FIG. 3 illustrates the delay concept of presentation to a user of a first (rear) signal source when occurring simultaneously with a second (front) signal source of a method according to an embodiment of the invention.

FIG. 3 shows a hearing instrument (HI) catch-up process illustrated by a number of events. The horizontal axis defines the time, e.g. the 'input time' and 'output time' of an acoustical event (sound, 'sound 1' and 'sound 2') picked up or replayed by the hearing instrument. The vertical axis of the top graph defines the amplitude (or sound pressure level) of the acoustical event in question. The vertical axis of the bottom graph defines the delay in presentation (output) associated with a particular sound ('sound 1') at different points in time. The graphs illustrate that the input and output times of acoustical events picked up by a front microphone (here 'sound 2') of the hearing instrument are substantially equal (i.e. no intentional delay), whereas the input and output times of (simultaneous) acoustical events picked up by a rear microphone (here 'sound 1') of the hearing instrument are different illustrating the output of the acoustical events picked up by a rear microphone are delayed compared to the 'corresponding' (simultaneous) events picked up by the front microphone and that the delays are decaying over time (indicating the acoustical events picked up by a rear microphone are delayed but replayed at an increased rate to allow the rear sounds to 'catch up' with the front sounds). At event 1 (start of 'sound 1'), energy is detected in the rear signal ('sound 1') whilst the front signal ('sound 2') is active. The HI action is to save the rear signal for later. Notice that the delay of 'sound 1' is undecided at this point, since the sound 1 has to wait for sound 2 to finish. Moreover, it is the part of sound 1 picked up first which is delayed most. At event 2 (end of 'sound 2'), the front signal has "ended" (is no longer active). The HI action is to start playing the recorded rear signal at the next available time instant, while the HI continues saving the rear signal (now the delay of the first part of sound 1 is known; this is the maximal delay, cf. lower graph). The rear signal is time compressed in the following frames, and the delay is hereby reduced in steps. At event 3, the rear channel has caught up with front channel (delay of 'sound 1' is zero, cf. lower graph). There is hence no need to record and time-compress the rear channel any longer. An intermediate delay of 'sound 1' relative to its original occurrence is indicated between event-2- and event-3 in the lower graph of FIG. 3.

FIG. 4 illustrates various aspects of the store, delay and catch-up concept algorithms according to embodiments of the present invention. For illustrative purposes hatching is used to distinguish different signals (i.e. signals that differ in some property, be it acoustic origin (e.g. front and rear) or processing (e.g. one signal being processed with unconverged and the other signal being processed with converged parameters after a significant change in a generating parameter of the signal). Many different parameters or properties can be used to characterize and possibly separate the sounds. Examples of such parameters and properties could be direction, frequency range, modulation spectrum, common onsets, common offsets, co-modulation and so on. Each rectangle of a signal in FIG. 4 can be thought of as a time frame comprising a predefined number of digital samples representing the signal. The overlap in time of neighbouring rectangles indicates an intended overlap in time of successive time frames of the signal.

Figure 4A:
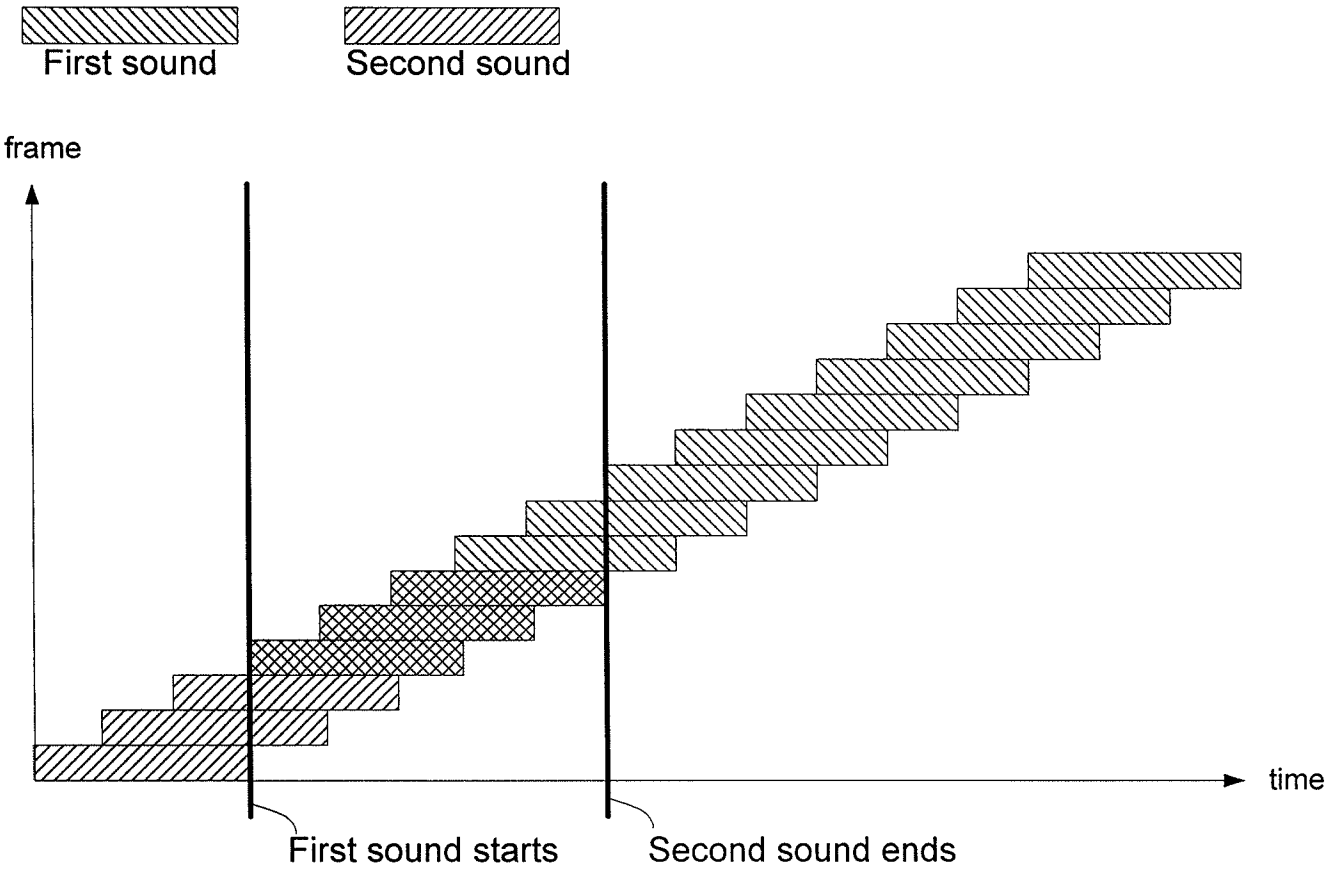
FIG. 4 illustrates various aspects of the store, delay and catch-up concept algorithms according to the present invention, FIG. 4*a* showing two sounds that partly overlap in time, FIG. 4*b* showing the output after the first sound has been delayed, FIG. 4*c* showing the output after the first sound has been delayed and played back faster, FIG. 4*d* showing the difference between the first sound input and the first sound output, FIG. 4*e* showing the two input sounds "separated", and FIG. 4*f* showing the storage and fast replay of a sound where processing waits for parameters to converge.

FIG. 4*a* shows two sounds partially overlapping in time. The two events that mark the start and the end of the overlap are identified. In the following figure some details concerning how the overlap in time between the two sounds can be removed.

Figure 4B:
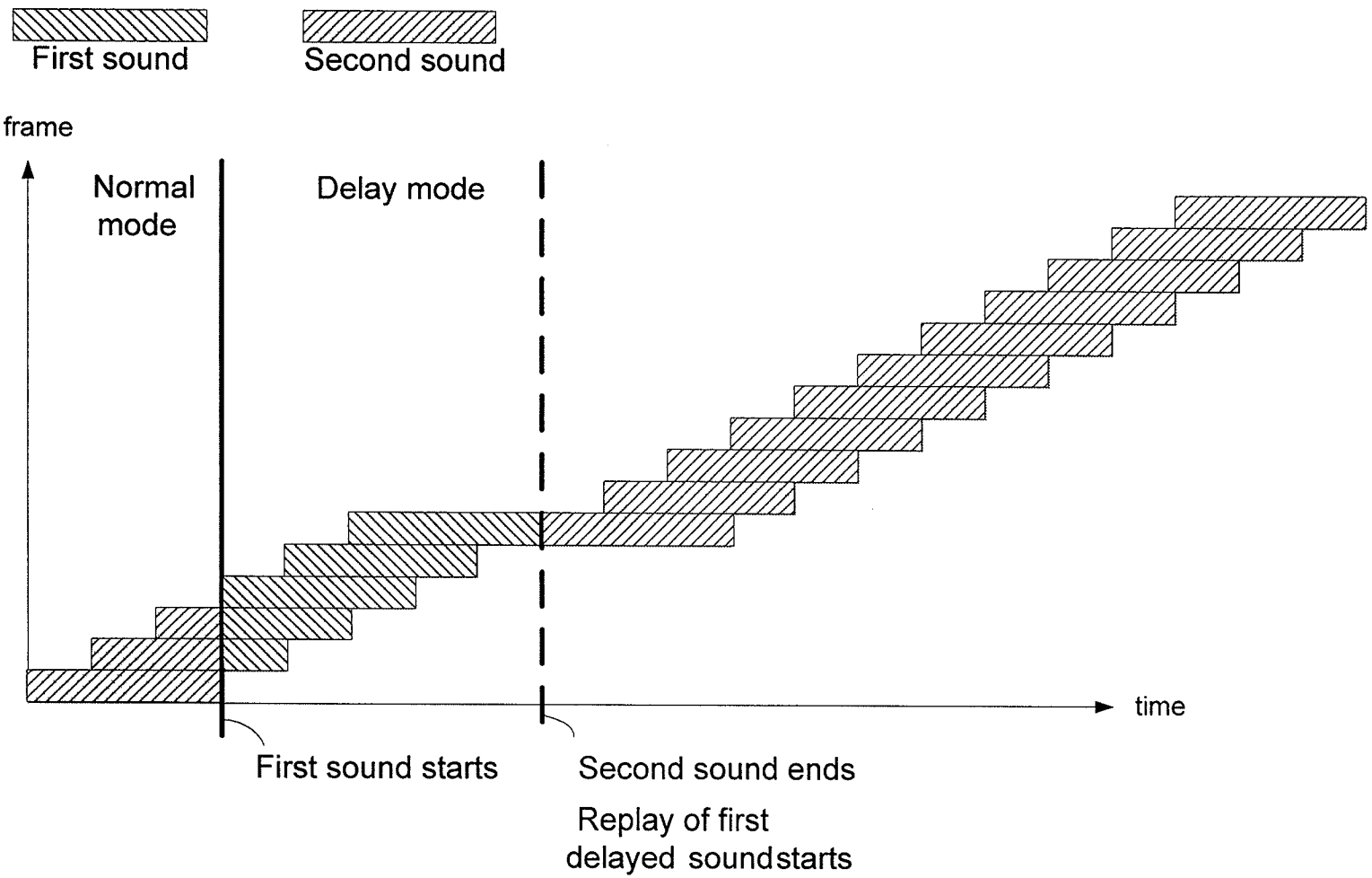

FIG. 4*b* shows how the overlap can be removed by delaying the first sound until the second sound ended (without introducing 'fast replay'). However, this procedure introduces a delay that has to be addressed in order to keep the delay from continuously building up. The solution may be acceptable, if appropriate consecutive delays are available in the second sound (or if silent noisy, or vowel-type periods exist that can be fragmentarily used), so that the first sound can be replayed in such available (silent or noisy) moments of the second sound.

Figure 4C:
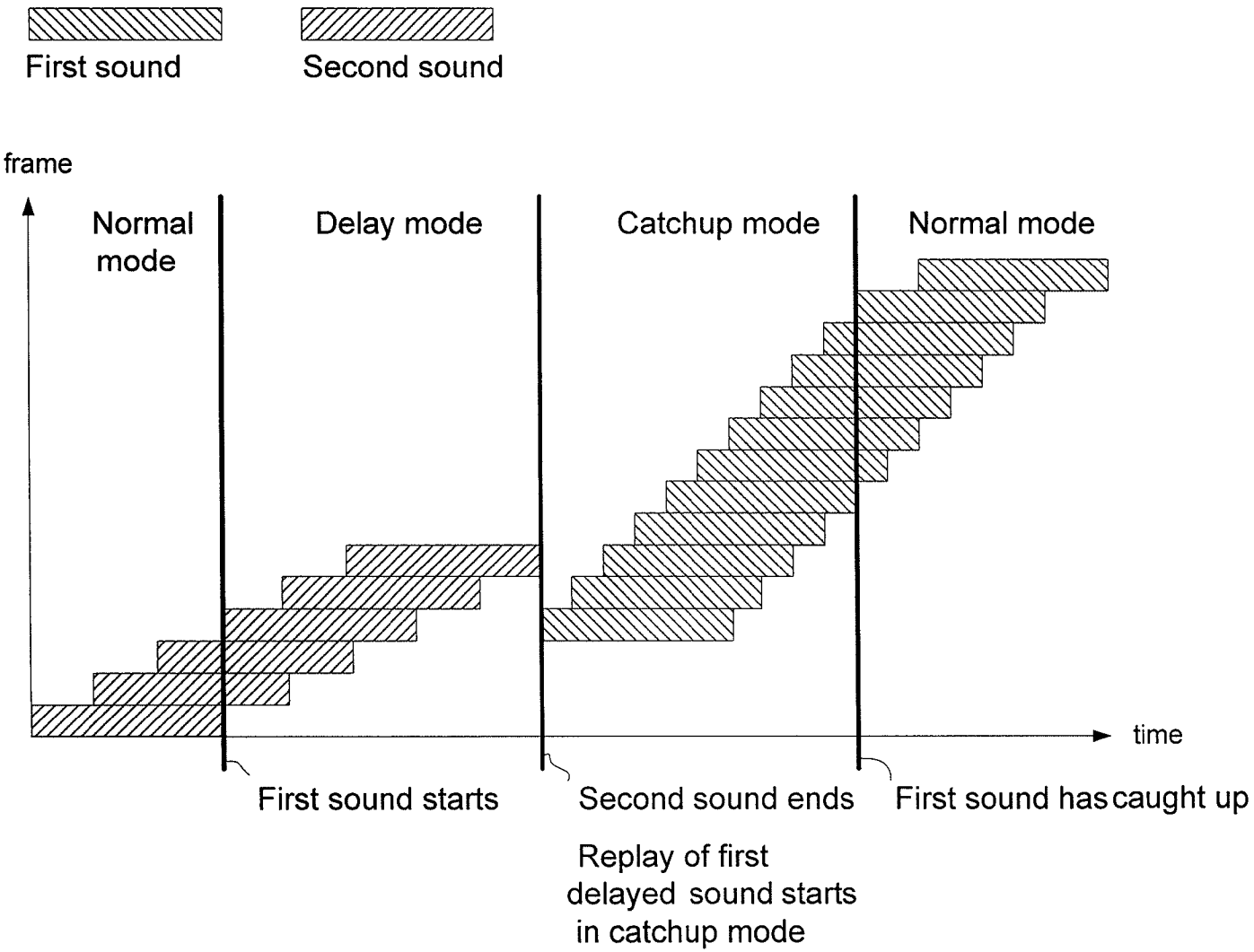

FIG. 4*c* shows how the overlap of sounds can be removed by delaying the first sound until the second sound ends ('delay mode')—and moreover how a faster playback (here implemented with SOLA) leads to catching up with the input sound (catchup mode); marking the event where the "First sound has caught up" after which a 'normal mode' of operation prevails. In the 'catchup mode', the overlap of successive time frames is larger than in the 'normal mode' indicating that a given number of time frames are output in a shorter time in a 'catchup mode' than in a 'normal mode'.

Figure 4D:
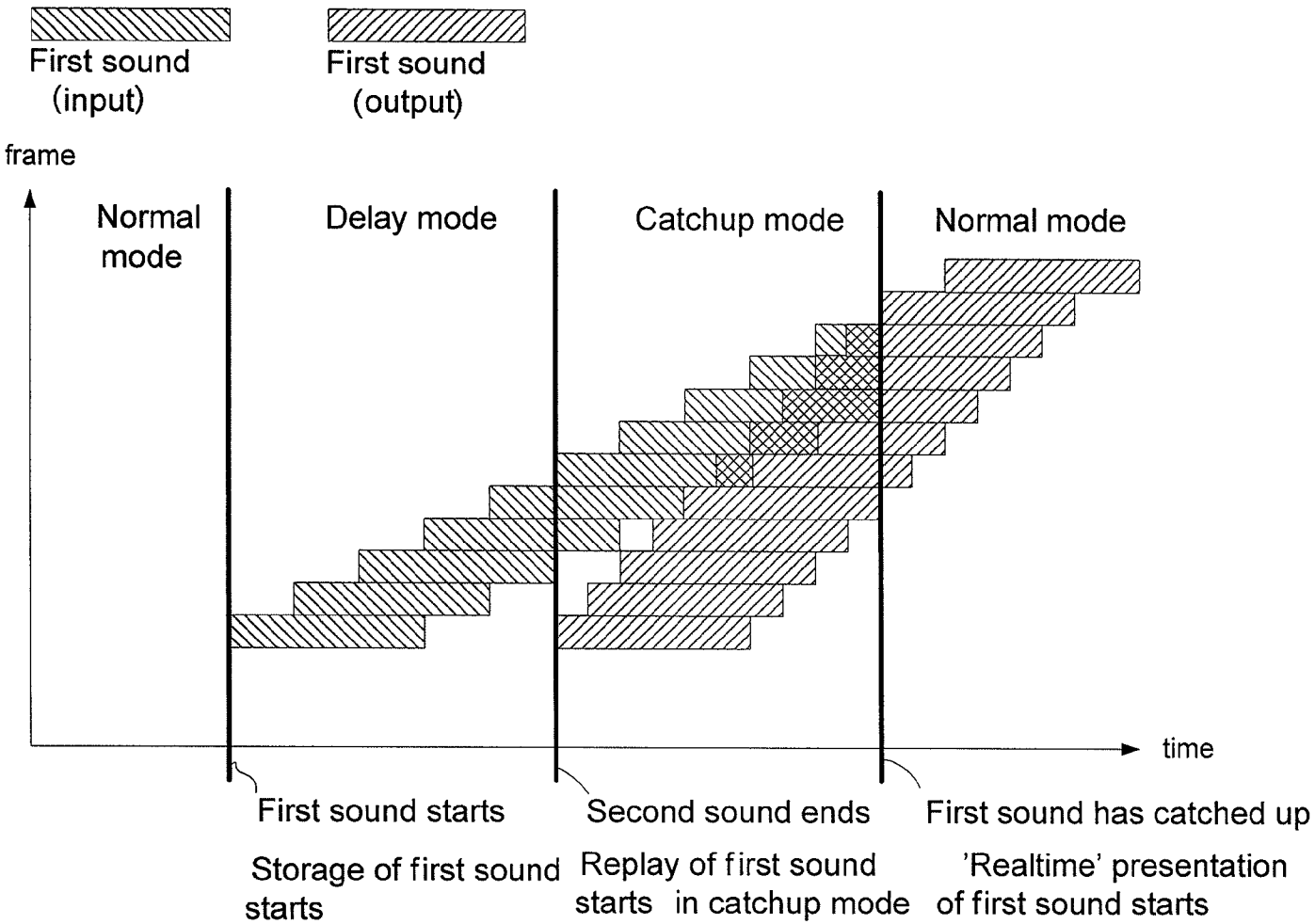

FIG. 4*d* shows the first sound input and first sound output without the second sound. The figure shows how each frame is delayed in time, and that the delay is decreased in a catchup mode for each frame until the sound has caught up after which the first sound output is output in a 'normal mode' ('realtime' output with same input and output rate).

Figure 4E:
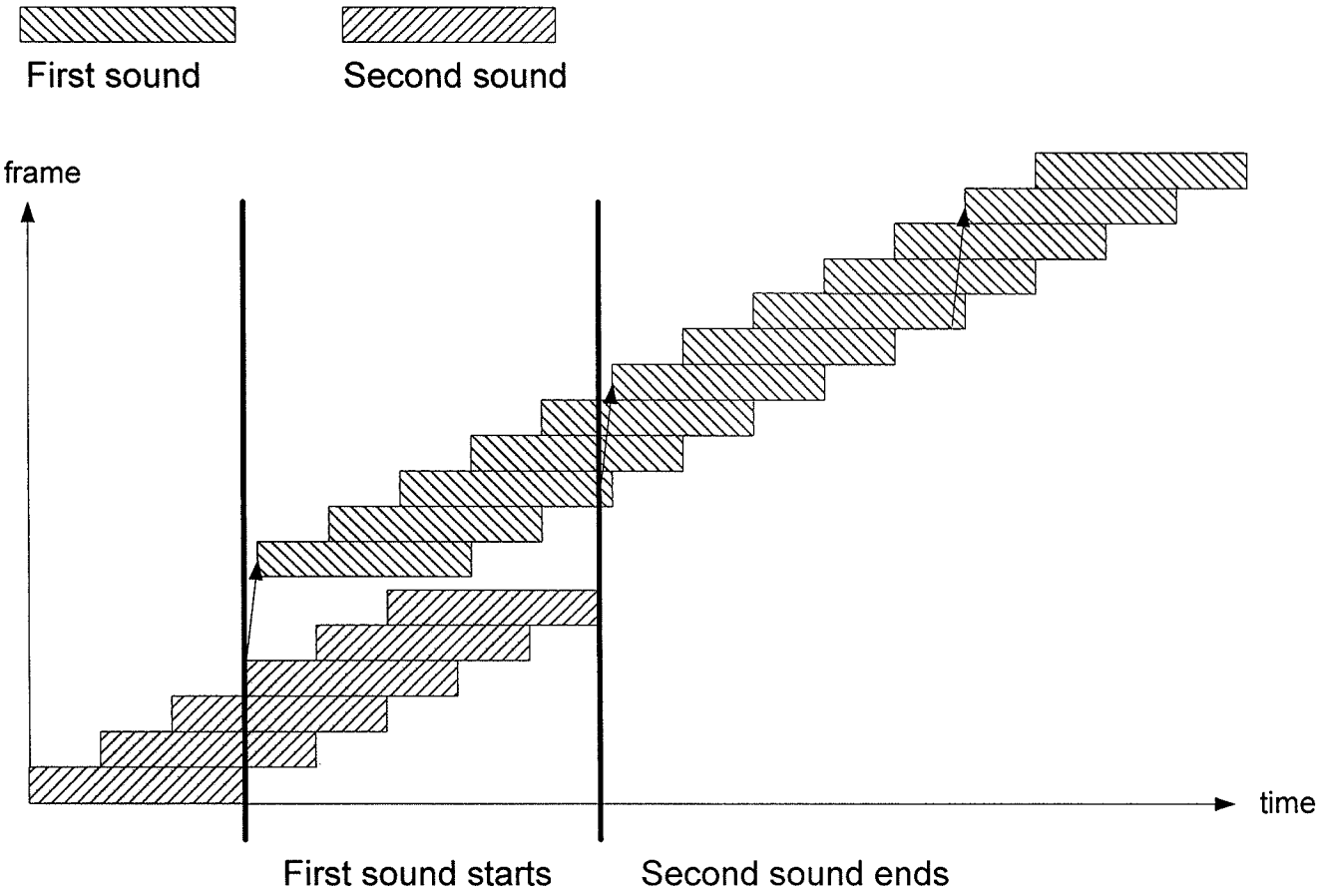

FIG. 4*e* shows that the first and second sound separately. The two signals are each characterised by the direction of hatching. FIG. 4*a* showed the visual mixture of the two signal, whilst FIG. 4*e* shows the result of a thought separation process using the special characteristics of each signal.

Figure 4F:
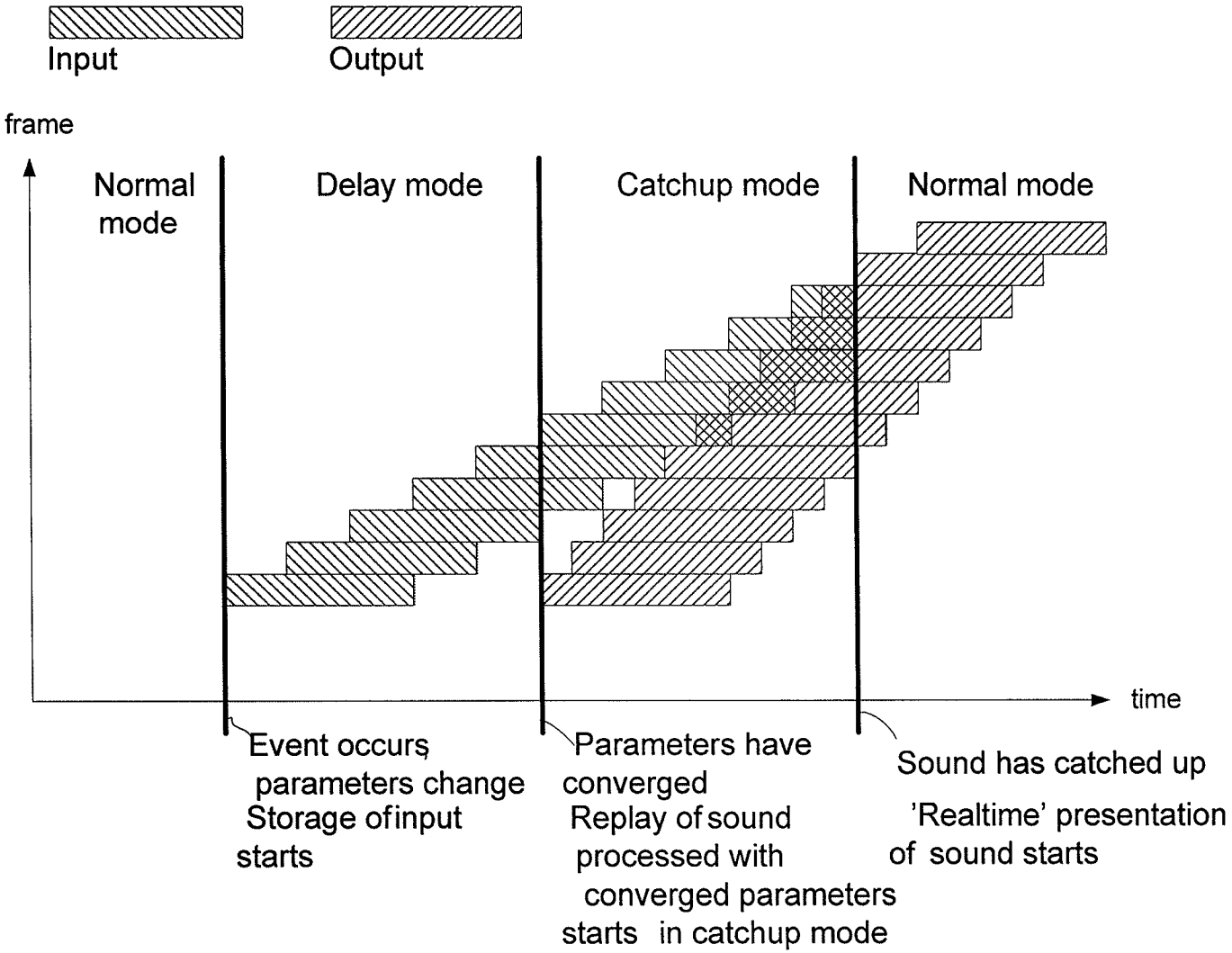

FIG. 4*f* shows an analogy to FIG. 4*d* where a single sound is delayed until the parameters have converged, and then the sound is processed with the converged parameters and played back faster in order to catch up with the input. Examples of usage already given: Modulation filtering, directionality parameters, etc.

Figure 5:
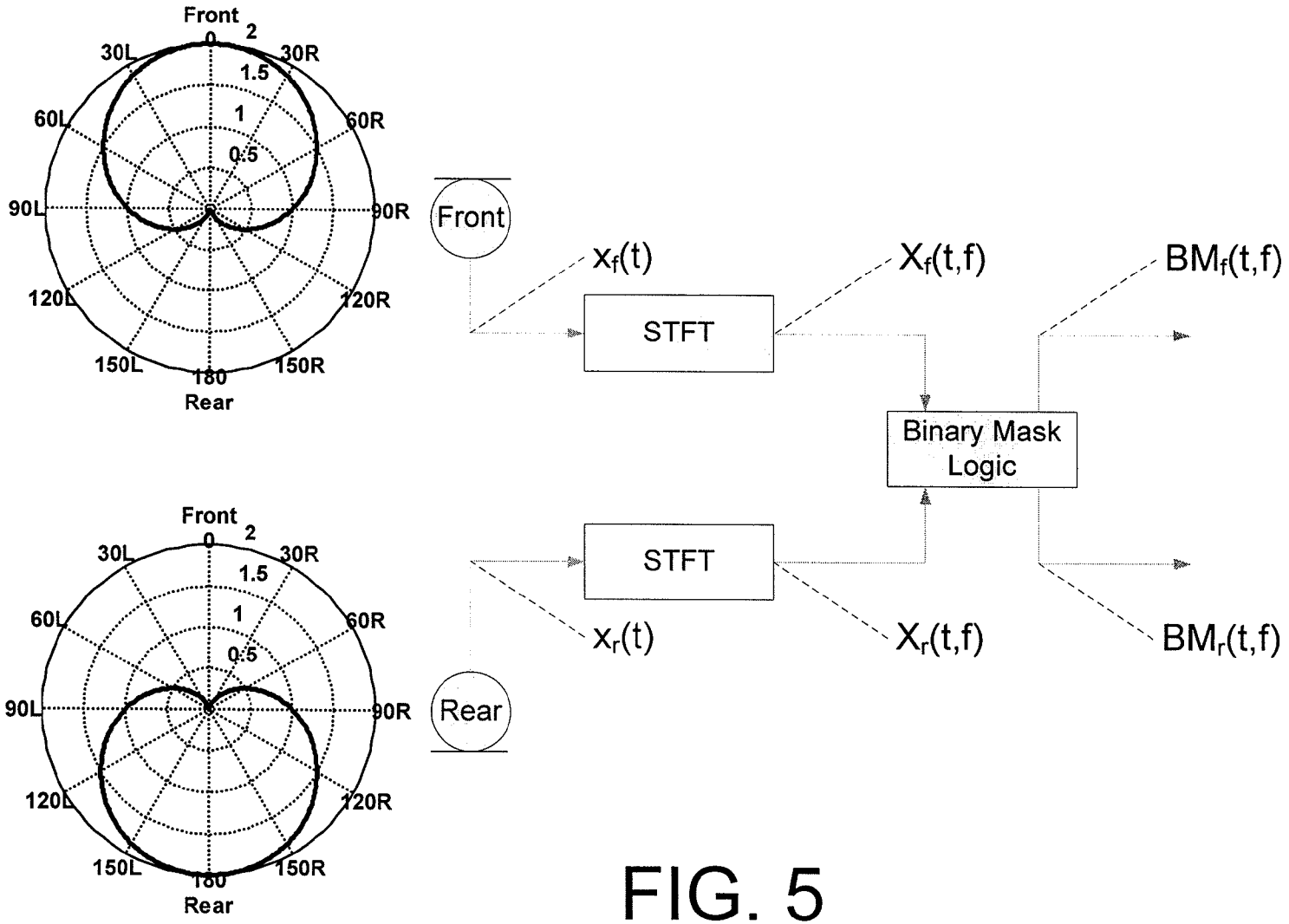
FIG. 5 shows how binary masks can be obtained from comparing the output of directional microphones.

FIG. 5 shows how two microphones (Front and Rear in FIG. 5) with cardioid patterns pointing in opposite directions can be used to separate the sound that emerge from the front from the sound that emerge from the rear. The comparison is binary and takes place in the time-frequency domain, after a Short Time Fourier Transformation (STFT) has been used to obtain the amplitude spectra $|X_f(t,f)|$ and $|X_r(t,f)|$. In order to obtain the front signal, the Binary Mask Logic outputs a front mask $BM_f(t,f)=1$ for the time-frequency bins where $X_f(t,f) \geq X_r(t,f)$ and $BM_f(t,f)=0$ for the time-frequency bins where $X_f(t,f) < X_r(t,f)$. The mask pattern $BM_f(t,f)$ specifies at a given time (t) which parts of the spectrum (f) that are dominated by the frontal direction. In FIG. 5, the Binary Mask Logic unit determines the front and rear binary mask pattern functions $BM_f(t,f)$ and $BM_r(t,f)$ based on the front and rear amplitude spectra $X_f(t,f)$ and $X_r(t,f)$ ($BM_r(t,f)$ being e.g. determined as $1-BM_f(t,f)$).

Figure 6:
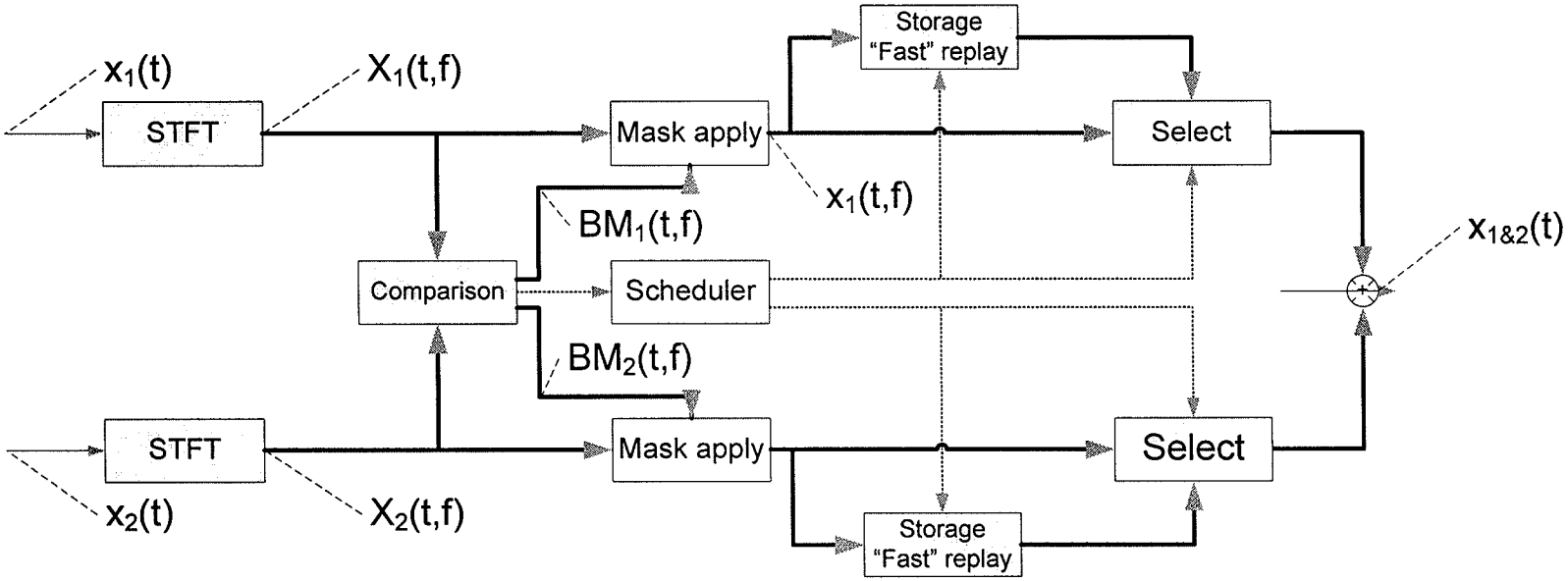
FIG. 6 shows how binary masks obtained from comparing two signals can be used with a scheduler to build a system capable of decreasing the overlap in time using delay, and fast replay.

FIG. 6 shows how two signals $x_1(t)$ and $x_2(t)$ after transformation to the time-frequency domain in respective STFT units providing corresponding spectra $X_1(t,f)$ and $X_2(t,f)$ can be compared in Comparison unit in an equivalent manner to that shown for the directional microphone inputs in FIG. 5. The Comparison unit generates the Binary Mask Logic outputs $BM_1(t,f)$, $BM_1(t,f)$ (as described above), which are also forwarded to a Scheduler unit. In the Mask apply units the binary masks $BM_1(t,f)$ and $BM_2(t,f)$, respectively, are used to select and output the part of the sounds $x_1(t,f)$ and $x_2(t,f)$, respectively, that are dominated by either signal $x_1(t)$ or $x_2(t)$. Comparing the patterns in the Scheduler unit (a control unit for generating an event-control signal) generates respective outputs for controlling respective Select units. Each Select unit (one for each processing path for processing $x_1(t,f)$ and $x_2(t,f)$, respectively) selects as an output either an undelayed input signal and a delayed and possibly fast replayed input signal (both inputs being based on the output of the corresponding Mask apply unit) or alternatively a zero output. The outputs of the Select units are added in the sum unit (+ in FIG. 6). The output of the sum unit, $x_{1\&2}(t)$, may e.g. provide a sum of sounds, one of the sounds, e.g. $x_1(t)$, in an undelayed ('realtime', with only the minimal delay of the normal processing) version and the other sound, e.g. $x_2(t)$, in a delayed (and possibly fast play back, cf. e.g. FIG. 4*d*) version, $x_{1\&2}(t)$ thereby constituting an improved output signal with removed or decreased time overlap between the two signals $x_1(t)$ and $x_2(t)$.

Temporal Masking and Transposition

Figure 7:
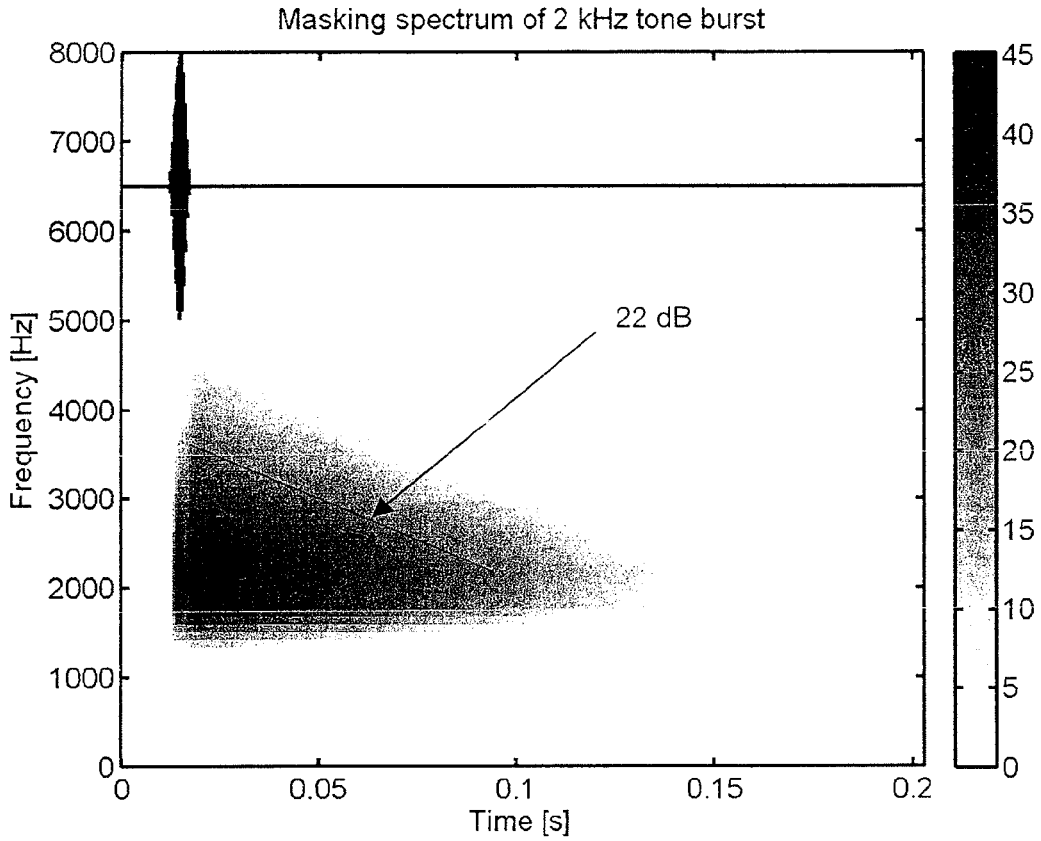
FIG. 7 shows simultaneous and temporal masking of a 2 kHz tone burst with 70 dB level.

FIG. 7 shows the dynamic masking threshold under a 70 dB tone at 2 kHz. The tone burst is plotted in the upper left side (with scaled amplitude), and the masking spectrum is delayed with respect to the sound due to calculation delay. The inclined solid line emphasizes parts of the 22 dB boundary (see arrow in FIG. 7). For simplicity, the decay of the masking threshold is modeled as a linear reduction in the threshold in dB over time. For the intended algorithm, the necessary delay can be diminished by transposing the masked signal. E.g., for this specific configuration, a new 22 dB component at 2 kHz would have to be delayed until 0.1 s in order to be audible, however it could be made audible around 3500 Hz at 0.05 seconds. Essentially, it is the shape of the masking template spectrum that determines the necessary amount of transposition to make the new component audible. A positive effect of the minimized delay is that the combined extension of the masking due to the first and new component is minimized as well.

Look-a-Head Delay

The present invention utilizes the time-variant delay to obtain a signal dependent look-a-head delay in the hearing aid. Look-a-head is routinely used to synchronize the application of calculated level adjustments to an input signal, by delaying the input signal by the sum of the calculation delay and the prescribed look-a-head delay. E.g. the level calculations could be based on 7 input samples, and take 2 samples to calculate, thus the input signal should be delayed 6 samples t achieve alignment if the weights summing of the 7 input samples are symmetric (a 7 samples long FIR filter has a delay of 4 samples, plus the calculation delay which is 2 samples in this example). For processing with parallel filters, the delay of each processing channel could be synchronized by trivial amendment of zeros.

The present invention differs from this by the fact that a delay, which the algorithm can account for, can be dynamically determined from the input signal, e.g. by looking at how certain calculated detectors evolve over time. This is illustrated by the block diagram in FIG. 8.

Figure 8:
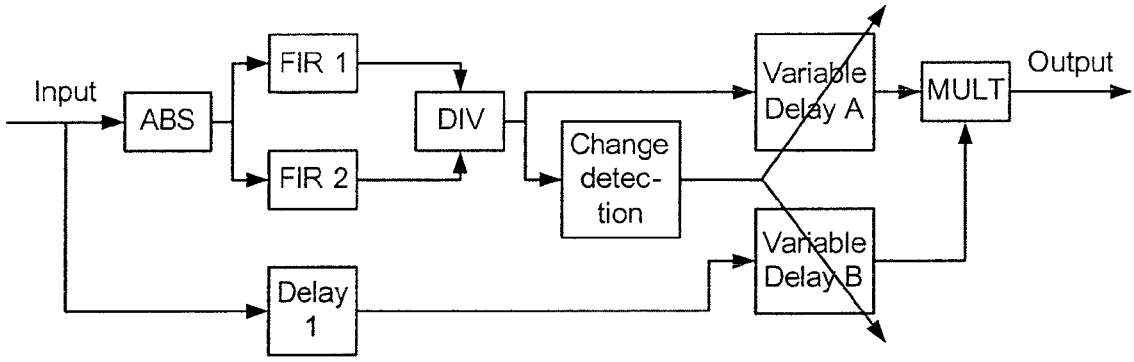
FIG. 8 shows an example where an input driven delay unit is added to a conventional look-a-head setup.

FIG. 8 shows an example or a circuit where an input driven delay unit is added to a conventional look-a-head setup. The block Delay 1 compensates for the calculation delay needed to obtain nominator and denominator for the division, in order to align the signal with the gain coefficient. Conventional non-linear processing (e.g. compression table look up etc.) of that ratio is omitted; however, Delay 1 should compensate for that as well. The variable delays Delay A and Delay B are controlled by the Change detection algorithm (event control unit).

Specific Issues Concerning a Directionality System

A specific example of the aforementioned dynamical look-a-head delay can be utilized in a directionality system. When a new sound source appears in the auditory scene, the a system according to present disclosure allows the system to wait until the spatial parameters defining the new source has converged—in general, this takes longer time than the actual calculation of such parameters. Then the converged parameters can be applied to the input signal consisting of the whole new source.

The invention is defined by the features of the independent claim(s). Preferred embodiments are defined in the dependent claims. Any reference numerals in the claims are intended to be non-limiting for their scope.

Some preferred embodiments have been shown in the foregoing, but it should be stressed that the invention is not limited to these, but may be embodied in other ways within the subject-matter defined in the following claims.

REFERENCES

EP 0 869 697 (LUCENT TECHNOLOGIES) 7 Oct. 1998

EP 1 005 783 (PHONAK) 25 Feb. 1999

US 2007/009122 (SIEMENS AUDIOLOGISCHE TECHNIK) 11 Jan. 2007

U.S. Pat. No. 7,231,055 B2 (PHONAK) 2 May 2002

WO 2004/077090 (OTICON) 10 Sep. 2004

WO 2008/028484 (GN RESOUND) 13 Mar. 2008

WO 02/32208 (PHONAK) 25 Apr. 2002

[Athineos] had Matlab code for modulation spectrum modification at http://www.ee.columbia.edu/~marios/modspec/modcodec.html. The page and code is not available on the Internet any longer.

[Atlas et al., 2004] Atlas, L., Li, Q., and Thompson, J. *Homomorphic modulation spectra*. ICASSP 2004, pp. 761-764. 2004.

[Cooke, 2006] M. Cooke, *A glimpsing model of speech perception in noise*, Journal of the Acoustical Society of America, Vol. 119, No. 3, pages 1562-1573, 2006.

[Laugesen et al., 1999] Laugesen, S., Hansen, K. V., and Hellgren, J. *Acceptable Delays in Hearing Aids and Implications for Feedback Cancellation*. EEA-ASA. 1999.

[Jourjine et al., 2000] Jourjine, A., Rickard, S., and Yilmaz, O. *Blind separation of disjoint orthogonal signals: demixing N sources from 2 mixtures*. IEEE International Conference on Acoustics, Speech, and Signal Processing, 2000.

[Moore, 1989] Moore, B. C. J. *An introduction to the psychology of hearing*. Third ed., Academic Press San Diego, Calif., 1989.

[Moore, 2007] Moore, B. C. J. *Cochlear Hearing Loss, Physiological, Psychological and Technical Issues*. Second ed., Wiley, 2007.

[Oxenham et al., 2003] Oxenham, A. J. and Bacon, S. P. *Cochlear Compression: Perceptual Measures and Impli-*

*cations for Normal and Impaired Hearing*. Ear and Hearing 24(5), pp. 352-366. 2003.

[Pedersen et al., 2005] Pedersen, M. S., Wang, D., Larsen, J., Kjems, U., *Overcomplete Blind Source Separation by Combining ICA and Binary Time-Frequency Masking*, IEEE International workshop on Machine Learning for Signal Processing, 2005, pp. 15-20, 2005.

[Pedersen et al., 2006] Pedersen, M. S., Wang, D., Larsen, J., and Kjems, U. *Separating Underdetermined Convolutive Speech Mixtures*. ICA 2006. 2006.

[Prytz, 2004] Prytz, L. *The impact of time delay in hearing aids on the benefit from speechreading*. Magister dissertation, Lunds Univeristy, Sweden. 2004.

[Roweis, 2001] Roweis, S. T. *One Microphone Source Separation*. Neural Information Processing Systems (NIPS) 2000, pp. 793-799 Edited by Leen, T. K., Dietterich, T. G., and Tresp, V. Denver, Colo., US, MIT Press. 2001

[Sanjuame, 2001] Sanjuame, J. B. *Audio Time-Scale Modification in the Context of Professional Audio Post-production*. Research work for PhD Program Informática i Comunicació digital. 2002.

[Schimmel, 2007] Schimmel, S. M. *Theory of Modulation Frequency Analysis and Modulation Filtering with Applications to Hearing Devices*. PhD dissertation, University of Washington. 2007.

[Schimmel et al., 2008] Schimmel, S. M. and Atlas, L. E. *Target Talker Enhancement in Hearing Devices*. ICASSP 2008, pp. 4201-4204. 2008.

[Wang, 2005] Wang, D. *On ideal binary mask as the computational goal of auditory scene analysis*, Divenyi P (ed): Speech Separation by Humans and Machines, pp. 181-197 (Kluwer, Norwell, Mass., 2005).

[Wang et al., 2008] Wang, D., Kjems, U., Pedersen, M. S., Boldt, J. B., and Lunner, T. *Speech perception in noise with binary gains*. Acoustics '08. 2008.

The invention claimed is:

1. A method of operating an audio processing device for processing an electric input signal representing a first sound signal or sound component and providing a processed electric output signal, the method comprising:

a) receiving the electric input signal representing the first sound signal or the sound component;

b) providing an event-control parameter indicative of changes related to the electric input signal and for controlling the processing of the electric input signal;

c) storing a representation of the electric input signal or a part thereof;

d) providing the processed electric output signal with a configurable delay based on the stored representation of the electric input signal or a part thereof and controlled by the event-control parameter, wherein the time-delay of the first sound signal or the sound component is minimized by combination with a frequency transposition of the signal, wherein the frequency transposition is based on a model of the human auditory system, wherein the first sound signal or the sound component is transposed in frequency to utilize a faster release from masking, wherein the model of the human auditory system, including the masking threshold vs. frequency, is customized to a hearing impairment of a particular user, wherein the user's own voice is separated from other acoustic sources, and wherein the electric input signal is separable into a first electric input signal representing an acoustic source other than the user's own voice and a second electric input signal representing the user's own voice.

2. A method according to claim 1, further comprising;

e) extracting characteristics of the stored representation of the electric input signal; and f) using the characteristics to influence the processed electric output signal.

3. A method according to claim 1, wherein monitoring changes related to the electric input signal comprises detecting that the electric input signal represents sound signals from two spatially different directions relative to a user, and the method further comprises separating the electric input signal in the first electric input signal representing a first sound of a first duration from a first start-time to a first end-time and originating from a first direction, and the second electric input signal representing a second sound of a second duration from a second start-time to a second end-time originating from a second direction, and wherein the first electric input signal is stored and a first processed electric output signal is generated from the first electric input signal and presented to the user with a delay relative to a second processed electric output signal generated from the second electric input signal.

4. A method according to claim 1 comprising providing that the event-control parameter indicative of changes related to the electric input signal and for controlling the processing of the electric input signal is automatically generated.

5. A method according to claim 1, wherein changes related to the electric input signal are extracted from the electrical input signal, or from the stored electrical input signal, or based on inputs from other sources.

6. A method according to claim 1, the method comprising processing a signal originating from the electric input signal in a parallel signal path without additional delay, so that a processed electric output signal with a configurable additional delay and a processed electric output signal without additional delay are provided.

7. A method according to claim 1, further comprising:

monitoring changes related to the electric input signal including detecting that a large scale parameter change occurs;

providing that the electric input signal is stored until the parameters have converged; and replaying a processed output signal processed with the converged parameters.

8. A method according to claim 7, wherein the delay introduced by the storage of the electric input signal is removed when the parameters have converged and the output signal has caught up with the input signal.

9. A method according to claim 1, further comprising:

providing modulation filtering in that the stored electrical input signal is used in the computation of a modulation spectrum of the electrical input signal.

10. A method according to claim 1, further comprising:

providing spatial filtering wherein monitoring changes related to the electric input signal comprises detecting that sound from a new direction is present and that the electrical input signal from the new direction is isolated and stored so that the converged spatial parameters can be determined from the stored signal and that the beginning of sound from that direction can be spatially filtered with converged spatial parameters.

11. An audio processing device, comprising:

a receiving unit for receiving an electric input signal representing an audio signal, a control unit for generating an event-control signal, a memory for storing a representation of the electric input signal or a part thereof, a signal processing unit for providing a processed electric output signal based on the stored representation of the electric input signal or a part thereof with a configurable delay controlled by the event-control signal, and a frequency transposition unit for minimizing a time-delay of a first sound component of the electric input signal relative to a second, previous sound component of the electric input signal by transposing the first sound component in frequency to a frequency range having a smaller masking delay, wherein the frequency transposition is based on a model of the human auditory system, wherein the model of the human auditory system, including the masking threshold vs. frequency, is customized to a hearing impairment of a particular user, wherein the user's own voice is separated from other acoustic sources, and wherein the electric input signal is separable into a first electric input signal representing an acoustic source other than the user's own voice and a second electric input signal representing the user's own voice.

12. An audio processing device according to claim 11 wherein the signal processing unit is adapted for extracting characteristics of the stored representation of the electric input signal, the signal processing unit being adapted to use the extracted characteristics to generate or influence the event-control signal and/or to influence the processed electric output signal.

13. An audio processing device according to claim 11 adapted for playing the processed electric output signal back faster than it is recorded in order to catch up with the input sound.

14. An audio processing device according to claim 11 comprising a directionality system for localizing a sound in the user's environment at least being able to discriminate a first sound originating from a first direction from a second sound originating from a second direction, the signal processing unit being adapted for delaying a sound from the first direction in case it occurs while a sound from the second direction is being presented to the user.

15. A data processing system comprising a signal processor and a software program code for running on the signal processor, wherein the software program code, when run on the data processing system, causes the signal processor to perform the steps of the method according to claim 1.

16. A non-transitory tangible recording medium having software program code comprising instructions stored thereon, that when executed, cause a signal processor of a data processing system to perform the steps of the method according to claim 1.

17. A method according to claim 5, wherein the other sources include local or remotely located algorithms or detectors.

* * * * *